US009796180B2

(12) United States Patent
Kitani et al.

(10) Patent No.: US 9,796,180 B2
(45) Date of Patent: Oct. 24, 2017

(54) PIEZOELECTRIC LIQUID EJECTION DEVICE WITH ELECTRODES FORMED ON PARTITION WALL SURFACES

(71) Applicant: CANON KABUSHIKI KAISHA, Tokyo (JP)

(72) Inventors: Koji Kitani, Chofu (JP); Hidehiko Fujimura, Hachioji (JP); Shumpei Tatsumi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/128,248

(22) PCT Filed: May 1, 2015

(86) PCT No.: PCT/JP2015/063701
§ 371 (c)(1),
(2) Date: Sep. 22, 2016

(87) PCT Pub. No.: WO2015/170777
PCT Pub. Date: Nov. 12, 2015

(65) Prior Publication Data

US 2017/0100931 A1 Apr. 13, 2017

(30) Foreign Application Priority Data

May 8, 2014 (JP) ..... 2014-096529
May 8, 2014 (JP) ..... 2014-096777

(51) Int. Cl.
*B41J 2/14* (2006.01)
*B41J 2/16* (2006.01)

(52) U.S. Cl.
CPC ..... *B41J 2/14209* (2013.01); *B41J 2/1429* (2013.01); *B41J 2/1615* (2013.01)

(58) Field of Classification Search
CPC .... B41J 2/14209; B41J 2/1429; B41J 2/1615; B41J 2/1609; B41J 2002/14217
See application file for complete search history.

(56) References Cited

U.S. PATENT DOCUMENTS 5,421,071 A 6/1995 Kanegae et al.
5,646,661 A * 7/1997 Asai ..... B41J 2/14209 347/68

(Continued)

FOREIGN PATENT DOCUMENTS

JP 2000-108361 A 4/2000
JP 3097298 B2 10/2000

(Continued)

OTHER PUBLICATIONS

International Preliminary Report on Patentability dated Nov. 8, 2016, in International Application No. PCT/JP2015/063701.

(Continued)

*Primary Examiner* — Henok Legesse
(74) *Attorney, Agent, or Firm* — Fitzpatrick, Cella, Harper & Scinto

(57) ABSTRACT

A liquid ejection device includes a piezoelectric transducer having a plurality of pressure chambers, a plurality of partitions dividing the plurality of pressure chambers, and a plurality of electrodes formed in the plurality of pressure chambers, respectively. The plurality of partitions each includes a first side wall and a second side wall that is positioned on a back surface side of the first side wall. The first side wall includes a first wall surface positioned at an upper portion thereof, the first wall surface being positioned so as to be set back in a normal direction from a second wall surface positioned below the first wall surface. A first electrode is formed on the second wall surface, and a second electrode is formed on the second side wall. An upper end (Continued)

of the second electrode is higher than an upper end of the first electrode.

10 Claims, 16 Drawing Sheets

(56) References Cited

U.S. PATENT DOCUMENTS

| | | | |
|---|---|---|---|
| 6,676,238 | B2 | 1/2004 | Fujimura et al. |
| 7,695,111 | B2 | 4/2010 | Kitani |
| 9,193,163 | B2 | 11/2015 | Ochi et al. |
| 9,365,037 | B2 | 6/2016 | Fukaya et al. |

FOREIGN PATENT DOCUMENTS

| | | | | | |
|---|---|---|---|---|---|
| JP | 2002-120367 | A | | 4/2002 | |
| JP | 2002-144588 | A | | 5/2002 | |
| JP | 202144588 | | * | 5/2002 | ..... B41J 2/045 |

OTHER PUBLICATIONS

International Search Report and Written Opinion in PCT/JP2015/063701, dated Aug. 4, 2015.

* cited by examiner

PIEZOELECTRIC LIQUID EJECTION DEVICE WITH ELECTRODES FORMED ON PARTITION WALL SURFACES

TECHNICAL FIELD

The present invention relates to a liquid ejection device.

BACKGROUND ART

A liquid ejection device (liquid ejection head) is configured to change pressure in a region filled with liquid (pressure chamber) to eject a liquid droplet from a nozzle. A drop-on-demand liquid ejection head is most popular and is used in an inkjet printer for printing a document or an image or the like.

Liquid ejection systems are broadly divided into two systems. One of the systems is a system in which a capacity of the pressure chamber is changed by applying a voltage to an electromechanical coupling element represented by a piezoelectric element, to thereby eject liquid. The other of the systems is a system in which a resistor produces heat by a voltage applied thereto to generate an air bubble in the pressure chamber, to thereby eject liquid.

In recent years, a liquid ejection device for an industrial use is required to eject liquid with an extremely high degree of precision. For example, liquid ejection on the order of picoliters is required. Further, liquid ejection even on the order of subpicoliters or smaller is required.

A technology involving changing a capacity of a pressure chamber (ink channel) by displacing a partition formed of a piezoelectric material in a shear mode, to thereby eject liquid, can precisely control the capacity change of the pressure chamber, and thus has attracted great attention.

CITATION LIST

Patent Literature

PTL 1: Japanese Patent No. 3097298

PTL 2: Japanese Patent Application Laid-Open No. 2000-108361

SUMMARY OF INVENTION

Technical Problem

However, the liquid ejection devices disclosed in PTL 1 and PTL 2 cannot necessarily obtain a sufficiently large amount of displacement of the partition. It is one way to increase an amount of displacement by increasing the applied voltage, but, increasing the applied voltage increases dielectric loss, an amount of produced heat, damage to the partition, and a load on a driver element, which reduces reliability.

It is an object of the present invention to provide a liquid ejection device that may improve efficiency of displacing a partition of a pressure chamber.

Solution to Problem

According to one aspect of an embodiment, a liquid ejection device includes a piezoelectric transducer including a plurality of pressure chambers; a plurality of partitions each including a piezoelectric material and dividing the plurality of pressure chambers; and a plurality of electrodes formed in the plurality of pressure chambers, respectively, wherein the plurality of partitions each include a first side wall and a second side wall that is positioned on a back surface side of the first side wall, wherein the first side wall includes a first wall surface positioned in an upper portion thereof, the first wall surface being positioned so as to be set back from a second wall surface positioned below the first wall surface in a direction normal to the first wall surface, wherein a first electrode of the plurality of electrodes is formed on the second wall surface, wherein a second electrode of the plurality of electrodes is formed on the second side wall, and wherein an upper end of the second electrode is higher than an upper end of the first electrode.

According to another aspect of an embodiment, a liquid ejection device includes a piezoelectric transducer including a plurality of pressure chambers; a plurality of partitions each including a piezoelectric material and dividing the plurality of pressure chambers; and a plurality of electrodes formed in the plurality of pressure chambers, respectively, wherein the plurality of partitions each include a first side wall and a second side wall that is positioned on a back surface side of the first side wall, wherein a first electrode of the plurality of electrodes is formed on a lower portion of the first side wall, and wherein a second electrode of the plurality of electrodes is formed on the second side wall and an upper surface of each of the plurality of partitions.

Advantageous Effects of Invention

According to the one embodiment of the present invention, each of the partitions has the first side wall and the second side wall that is positioned on the back surface side of the first side wall. The first side wall has the first wall surface positioned in the upper portion thereof, and the first wall surface is positioned so as to be set back from the second wall surface positioned below the first wall surface in the direction of the normal to the first wall surface. According to the one embodiment of the present invention, each of the partitions has a portion having a smaller thickness, and thus, the partitions are more easily displaced. In addition, according to the one embodiment of the present invention, the first electrode is formed on the second wall surface, the second electrode is formed on the second side wall, and the height of the upper end of the second electrode is higher than the height of the upper end of the first electrode. Therefore, according to the one embodiment of the present invention, an electric field applied to the partitions may be increased. Therefore, according to the one embodiment of the present invention, the partitions may be more easily displaced in a shear mode, and the efficiency of displacing the partitions may be improved.

Further, according to the one embodiment of the present invention, electrodes are formed not only on the side walls of the partitions but also on the upper surfaces of the partitions, and thus, the electric field applied to the partitions may be increased. Therefore, according to the one embodiment of the present invention, the partitions may be more easily displaced in the shear mode, and the efficiency of displacing the partitions may be improved.

Further features of the present invention will become apparent from the following description of exemplary embodiments with reference to the attached drawings.

DESCRIPTION OF EMBODIMENTS

First Embodiment

Figure 1:
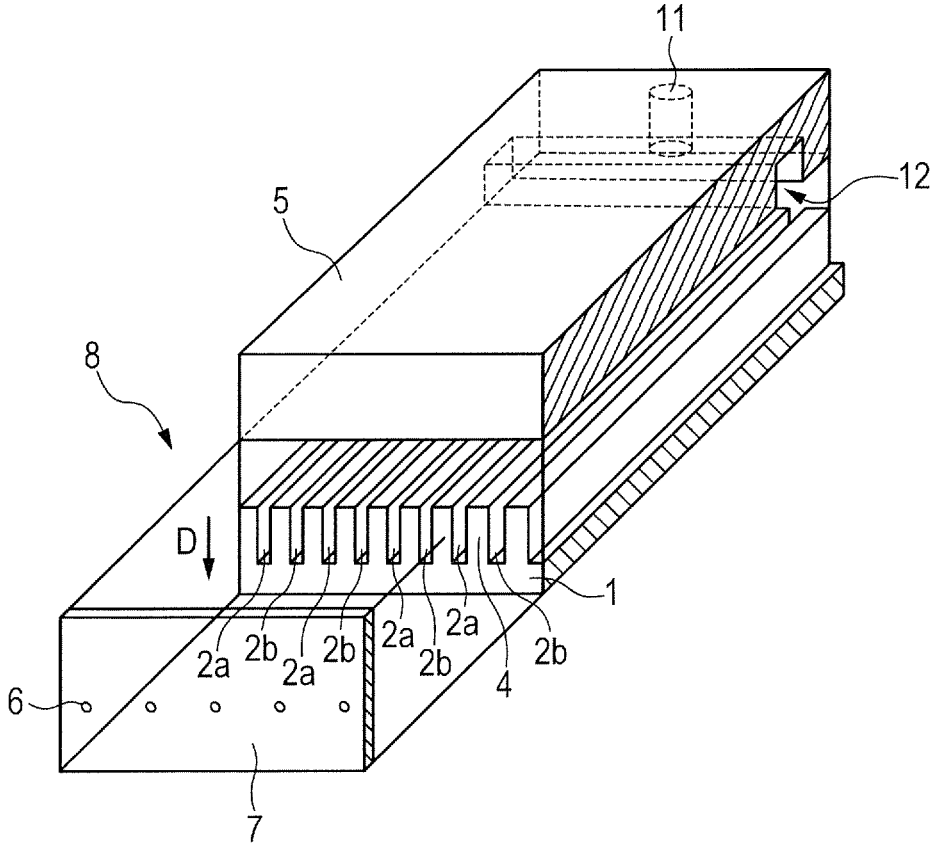
FIG. 1 is a perspective view schematically illustrating a liquid ejection device according to a first embodiment of the present invention.
Figure 2:
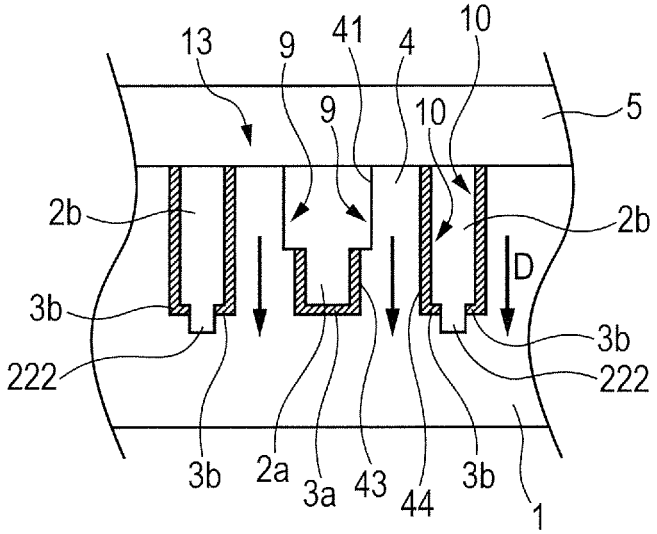
FIG. 2 is a sectional view illustrating a part of the liquid ejection device according to the first embodiment of the present invention.

A liquid ejection device according to a first embodiment of the present invention is described with reference to the drawings. FIG. 1 is a perspective view schematically illustrating the liquid ejection device according to this embodiment. FIG. 2 is a sectional view illustrating a part of the liquid ejection device according to this embodiment.

As illustrated in FIG. 1, the liquid ejection device according to this embodiment includes a piezoelectric transducer 8 including a piezoelectric plate 1, a cover plate 5 mounted on the piezoelectric plate 1, and an orifice plate 7.

As a material of the piezoelectric plate 1, a piezoelectric material is used. As such a piezoelectric material, for example, piezoelectric ceramics is used. As the piezoelectric ceramics, for example, a ferroelectric lead zirconate titanate (PZT)-based ceramics material is used. Polarization treatment is applied to the piezoelectric plate 1 in a direction of, for example, the arrow D. The piezoelectric plate 1 has a thickness of, for example, about 1 mm.

A plurality of grooves (openings) 2*a* and 2*b* are formed in the piezoelectric plate 1 so as to be in parallel with one another. Such grooves 2*a* and 2*b* are formed for the purpose of forming pressure chambers (liquid channels). The grooves 2*a* and 2*b* are formed using, for example, a diamond wheel. The grooves 2*a* and 2*b* have a depth of, for example, about 230 μm.

As illustrated in FIG. 2, the groove 2*a* has a smaller width on a lower side and has a larger width on an upper side. In other words, the groove 2*a* is formed of a groove having a smaller width and a groove having a larger width, which is formed over the groove having the smaller width.

The groove 2*b* has the same width on a lower side and on an upper side.

The groove 2*a* and the groove 2*b* are alternately formed.

A portion of the piezoelectric plate 1 between the groove 2*a* and the groove 2*b* is a partition 4. Each of the partitions 4 is formed for the purpose of separating the pressure chambers (liquid channels) formed by the grooves 2*a* and 2*b* from one another.

The partition 4 has a side wall 9 facing the groove 2*a* and a side wall 10 facing the groove 2*b*.

The side wall 9 of one partition 4 and the side wall 9 of another partition 4 adjacent to the one partition 4 are opposed to each other.

Further, the side wall 10 of one partition 4 and the side wall 10 of another partition 4 adjacent to the one partition 4 are opposed to each other.

The side wall 9 facing the groove 2*a* has a wall surface 41 positioned in an upper portion of the side wall 9 and a wall surface 43 positioned below the wall surface 41. Specifically, the side wall 9 has the wall surface 41 positioned in a portion of the side wall 9 including an upper end thereof and the wall surface 43 positioned in a portion of the side wall 9 including a lower end thereof. In other words, the side wall 9 has the wall surface 41 positioned on an upper side of the side wall 9 and the wall surface 43 positioned on a lower side of the side wall 9. The wall surface 41 positioned on the upper side of the side wall 9 is positioned so as to be set back from the wall surface 43 positioned below the wall surface 41 in a direction of a normal to the wall surface 41. In other words, the wall surface 41 positioned in the upper portion of the side wall 9 is retracted with respect to the wall surface 43 positioned below the wall surface 41.

The wall surface 41 is set back from the wall surface 43, and thus, there is a step between the wall surface 41 and the wall surface 43.

As described later, it is preferred that the wall surface 43 have a height that is 25% or more and 65% or less of a height of the side wall 9. In this case, the wall surface 43 has a height of, for example, about 115 μm.

Further, it is preferred that the wall surface 41 positioned in the upper portion of the side wall 9 be positioned so as to be set back by, for example, 10 μm or more from the wall surface 43 positioned below the wall surface 41 in the direction of the normal to the wall surface 41. The reason is that, if an amount of the set back of the wall surface 41 from the wall surface 43 is excessively small, processing of forming the wall surface 41 is difficult.

A wall surface 44 exists on the side wall 10 facing the groove 2*b*. A wall surface set back from the wall surface 44 does not exist on the side wall 10 facing the groove 2*b*. Because a wall surface set back from the wall surface 44 does not exist on the side wall 10, an entire surface of the side wall 10 facing the groove 2*b* is the wall surface 44. An upper end of the wall surface 44 is positioned above an upper end of the wall surface 43.

The wall surface 41 is set back from the wall surface 43, and thus, a portion of the partition 4 on an upper side has a thickness smaller than that of a portion of the partition 4 on a lower side. It is preferred that the portion of the partition 4 on the upper side have a thickness of, for example, 30 μm or more, for the purpose of securing a sufficient physical strength of the partition 4.

An electrode (drive electrode) 3*a* is formed in the groove 2*a*. The electrode 3*a* is used for applying, in combination with an electrode 3*b* to be described later, the partition (piezoelectric material) 4 with an electric field in a direction perpendicular to the polarization direction D to displace the partition 4 in a shear mode.

The electrode 3*a* is formed on a bottom surface and the wall surfaces 43 of the groove 2*a*. Specifically, the electrode 3*a* is not formed on entire surfaces of the side walls 9, but formed on the wall surfaces 43 positioned on the lower side of the side wall 9. A height of an upper end of the electrode 3*a* is the same as a height of the upper end of the wall surface 43.

The electrodes (drive electrodes, partial electrodes) 3*b* are formed in the groove 2*b*. The partial electrode 3*b* positioned on one side of the groove 2*b* and the partial electrode 3*b* positioned on the other side of the groove 2*b* are separated from each other by a separating groove 222 formed in a bottom surface of the groove 2*b*. The separating groove 222 is formed along a longitudinal direction of the groove 2*b* so as to extend from one end of the groove 2*b* to reach the other end thereof. Further, the electrode 3*b* may be formed on the bottom surface and the wall surfaces 44 of the groove 2*b*. Specifically, the electrode 3*b* may be formed on entire surfaces of the side walls 10 of the partitions 4. A height of an upper end of the electrode 3*b* is the same as a height of an upper end of the side wall 10 of the partition 4.

The upper end of the wall surface 44 is positioned above the upper end of the wall surface 43, and thus, the upper end of the electrode 3*b* is positioned above the upper end of the electrode 3*a*.

As a material of the electrodes 3*a* and 3*b*, for example, a metal material such as aluminum or nickel is used. The electrodes 3*a* and 3*b* are formed by, for example, vapor deposition or electroless plating.

The cover plate 5 is mounted onto the piezoelectric plate 1. It is preferred to use, as the cover plate 5, for example, a material having a coefficient of thermal expansion equivalent to that of the piezoelectric plate 1. In this case, as a material of the cover plate 5, the same material as that of the piezoelectric plate 1 is used. A liquid introduction port 11 is formed in the cover plate 5. Further, a manifold 12 is formed in the cover plate 5. An upper surface of the piezoelectric plate 1 and a lower surface of the cover plate 5 are bonded together with, for example, an epoxy-based adhesive (not shown).

The cover plate 5 is positioned above the grooves 2*a* and 2*b*, and thus, the pressure chambers are formed along the longitudinal direction of the grooves 2*a* and 2*b*. The pressure chamber (liquid chamber) 2*a* is filled with liquid from a liquid bottle (not shown) through the liquid introduction port 11 and the manifold 12. When the liquid to be ejected is ink, the pressure chamber (ink chamber) 2*a* is filled with the ink. The pressure chamber 2*a* is to be the liquid channel (ink channel).

The orifice plate (nozzle plate) 7 is mounted on an end surface of the piezoelectric plate 1. The orifice plate 7 is formed of, for example, plastic. Nozzles 6 are formed in the orifice plate 7 at positions corresponding to those of the pressure chambers 2*a*. The orifice plate 7 is bonded to the end surface of the piezoelectric plate 1 with, for example, an epoxy-based adhesive (not shown).

When a voltage is applied between the electrodes 3*a* and 3*b*, an electric field in a direction perpendicular to the polarization direction D is applied to the partition (piezoelectric material) 4 to displace the partition 4 in the shear mode. When the partition (movable wall) 4 is displaced, a capacity of the pressure chamber (liquid chamber) 2*a* is changed. By appropriately changing the capacity of the pressure chamber 2*a*, the liquid (ink) can be ejected through the nozzles 6.

As described above, a plurality of liquid ejecting portions 13 each having the pressure chamber 2*a* capable of ejecting the liquid are arranged in an array in the piezoelectric transducer 8.

In this embodiment, a portion of the partition 4 on the upper side has a smaller thickness than that of a portion of the partition 4 on the lower side.

Specifically, the partition 4 is reduced in thickness in part. Therefore, in this embodiment, compared with a case in which the entire partition 4 is formed so as to have a large thickness, the partition 4 is more easily displaced. In addition, in this embodiment, the upper end of the electrode 3*b* is positioned above the upper end of the electrode 3*a*. Therefore, in this embodiment, compared with a case in which the height of the upper end of the electrode 3*b* is the same as the height of the upper end of the electrode 3*a*, the electric field applied to the partition 4 (piezoelectric material) can be increased. Therefore, according to this embodiment, the partition 4 can be more easily displaced in the shear mode, and the efficiency of displacing the partition 4 can be improved.

(Evaluation Results)

Next, results of evaluation of the liquid ejection device according to this embodiment are described.

Figure 3:
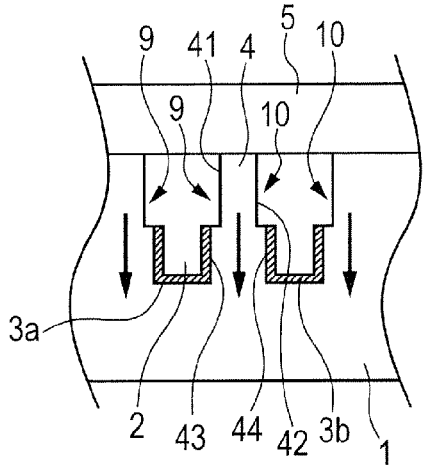
FIG. 3 is a sectional view illustrating a liquid ejection device according to a reference example.

The evaluation was made by comparing the liquid ejection device according to this embodiment and a liquid ejection device according to a reference example. The liquid ejection device according to this embodiment had the structure as illustrated in FIG. 2. The liquid ejection device according to the reference example had the structure as illustrated in FIG. 3. FIG. 3 is a sectional view illustrating the liquid ejection device according to the reference example.

In the liquid ejection device according to this embodiment, a depth of the grooves 2*a* and 2*b*, that is, a height of the side walls 9 and 10 of the partition 4 was 230 μm.

In the liquid ejection device according to the reference example, similarly to the case of the liquid ejection device according to this embodiment, a depth of a groove 2, that is, the height of the side walls 9 and 10 of the partition 4 was 230 μm.

In the liquid ejection device according to this embodiment, a height of the wall surface 43 positioned on the lower side of the side wall 9 of the partition 4 was 115 μm. Specifically, the height of the wall surface 43 was 50% of the height of the side wall 9 of the partition 4.

On the other hand, in the liquid ejection device according to this embodiment, a height of the wall surface 44 of the side wall 10 of the partition 4 was 230 μm, that was the same as the height of the side wall 10 of the partition 4.

In the liquid ejection device according to the reference example, the height of the wall surface 43 positioned on the lower side of the side wall 9 of the partition 4 was 115 μm similarly to the case of the liquid ejection device according to this embodiment. On the other hand, in the liquid ejection device according to the reference example, the height of the wall surface 44 positioned on the lower side of the side wall 10 of the partition 4 was also 115 μm. Specifically, in the liquid ejection device according to the reference example, not only the height of the wall surface 43 but also the height of the wall surface 44 was 50% of the height of the side walls 9 and 10 of the partition 4.

Figure 4:
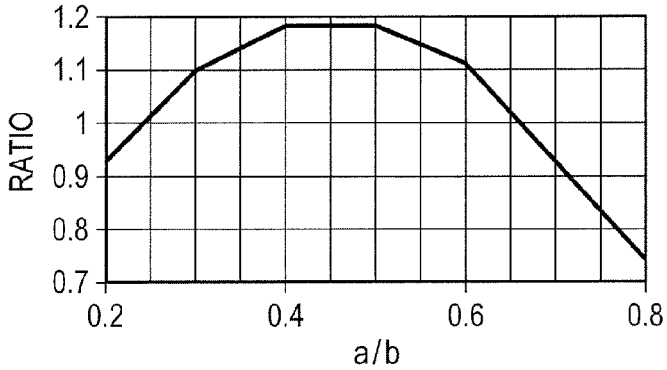
FIG. 4 is a graph illustrating results of measurement of an amount of displacement of a partition.

FIG. 4 is a graph showing results of measurement of an amount of displacement of the partition. A horizontal axis in FIG. 4 denotes a ratio of a height "a" of the wall surface 43 on the lower side of the side wall 9 of the partition 4 to a height "b" of the side wall 9 of the partition 4. A vertical axis in FIG. 4 denotes a ratio of the amount of displacement, provided that the amount of displacement in the liquid ejection device according to the reference example is 1.

As can be seen from FIG. 4, in a range in which a value of (a/b) is 25% or more and 65% or less, the ratio of the amount of displacement is 1 or more.

Therefore, by setting the value of "a" so that the value of (a/b) is 25% or more and 65% or less, the amount of displacement of the partition 4 can be improved.

As described above, in this embodiment, each of the partitions 4 has the first side wall 9 and the second side wall 10 that is positioned on the back surface side of the first side wall 9. The first wall surface 41 positioned in the upper portion of the first side wall 9 is positioned so as to be set back from the second wall surface 43 positioned below the first wall surface 41 in the direction of the normal to the first wall surface 41. According to this embodiment, each of the partitions 4 has a portion having a smaller thickness, and thus, the partitions 4 are more easily displaced. In addition, according to this embodiment, the first electrode 3*a* is formed on the second wall surface 43, the second electrode 3*b* is formed on the second side wall 10, and the height of the upper end of the second electrode 3*b* is higher than the height of the upper end of the first electrode 3*a*. Therefore, according to this embodiment, the electric field applied to the partition 4 can be increased. Therefore, according to this embodiment, the partitions 4 can be more easily displaced in the shear mode, and the efficiency of displacing the partitions 4 can be improved.

Second Embodiment

Figure 5:
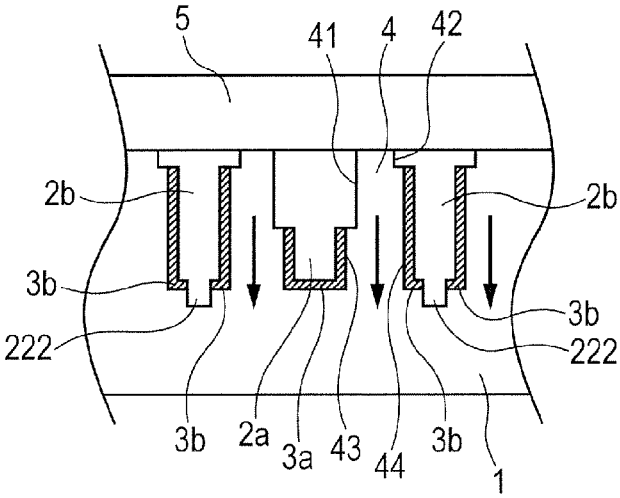
FIG. 5 is a sectional view illustrating a liquid ejection device according to a second embodiment of the present invention.

A liquid ejection device according to a second embodiment of the present invention is described. FIG. 5 is a sectional view illustrating the liquid ejection device according to this embodiment. Like reference symbols are used to designate like structural elements in the liquid ejection device according to the first embodiment illustrated in FIG. 1 to FIG. 4 and description thereof is omitted or is made only in brief.

In the liquid ejection device according to this embodiment, a wall surface 42 positioned in an upper portion of the side wall 10 is positioned so as to be set back from the wall surface 44 positioned below the wall surface 42 in a direction of a normal to the wall surface 42.

As illustrated in FIG. 5, the wall surface 42 positioned in the upper portion of the side wall 10 is positioned so as to be set back from the wall surface 44 positioned below the wall surface 42 in the direction of the normal to the wall surface 42. Specifically, the wall surface 42 positioned in a portion of the side wall 10 including an upper end thereof is positioned so as to be set back from the wall surface 44 positioned in a portion of the side wall 10 including a lower end thereof in the direction of the normal to the wall surface 42. In other words, the wall surface 42 positioned in the upper portion of the side wall 10 is retracted with respect to the wall surface 44 positioned below the wall surface 42. The wall surface 42 is set back from the wall surface 44, and thus, there is a step between the wall surface 42 and the wall surface 44.

As described later, it is preferred that the wall surface 44 positioned on a lower side of the side wall 10 have a height that is 1.4 times or more as much as the height of the wall surface 43 positioned on a lower side of the side wall 9 on a back surface side of the side wall 10. Further, it is preferred that the wall surface 44 positioned on the lower side of the side wall 10 have a height that is more than 50% of the height of the side wall 10. The height of the wall surface 44 positioned on the lower side of the side wall 10 is set so as to be more than 50% of the height of the side wall 10 for the purpose of applying a sufficient electric field to the partition 4 to obtain a large amount of displacement.

The wall surface 41 positioned on an upper side of the side wall 9 is positioned so as to be set back from the wall surface 43 positioned on the lower side of the side wall 9 in the direction of the normal to the wall surface 41.

In this embodiment, not only the wall surface 41 is positioned so as to be set back from the wall surface 43 in the direction of the normal to the wall surface 41, but also the wall surface 42 is positioned so as to be set back from the wall surface 44 in the direction of the normal to the wall surface 42. Therefore, in this embodiment, an upper portion of the partition 4 is reduced in thickness. Therefore, in this embodiment, the partition 4 is more easily displaced. Therefore, according to this embodiment, the partition 4 can be more easily displaced in the shear mode, and the efficiency of displacing the partition 4 can be further improved.

(Evaluation Results)

Next, results of evaluation of the liquid ejection device according to this embodiment are described.

The evaluation was made by comparing the liquid ejection device according to this embodiment and a liquid ejection device according to a reference example. The liquid ejection device according to this embodiment had the structure as illustrated in FIG. 5. The liquid ejection device according to the reference example had the structure as illustrated in FIG. 3.

In the liquid ejection device according to this embodiment, a depth of the grooves 2*a* and 2*b*, that is, a height of the side walls 9 and 10 of the partition 4 was 230 μm.

In the liquid ejection device according to the reference example, similarly to the case of the liquid ejection device according to this embodiment, a depth of a groove 2, that is, the height of the side walls 9 and 10 of the partition 4 was 230 μm.

In the liquid ejection device according to this embodiment, a height of the wall surface 43 positioned on the lower side of the side wall 9 of the partition 4 was 115 μm. Specifically, the height of the wall surface 43 was 50% of the height of the side wall 9 of the partition 4.

In the liquid ejection device according to this embodiment, a height of the wall surface 44 positioned on the lower side of the side wall 10 of the partition 4 was changed.

In the liquid ejection device according to the reference example, the height of the wall surface 43 positioned on the lower side of the side wall 9 of the partition 4 was 115 μm similarly to the case of the liquid ejection device according to this embodiment. On the other hand, in the liquid ejection device according to the reference example, the height of the wall surface 44 positioned on the lower side of the side wall 10 of the partition 4 was also 115 μm. Specifically, in the liquid ejection device according to the reference example, not only the height of the wall surface 43 but also the height of the wall surface 44 was 50% of the height of the side walls 9 and 10 of the partition 4.

Figure 6:
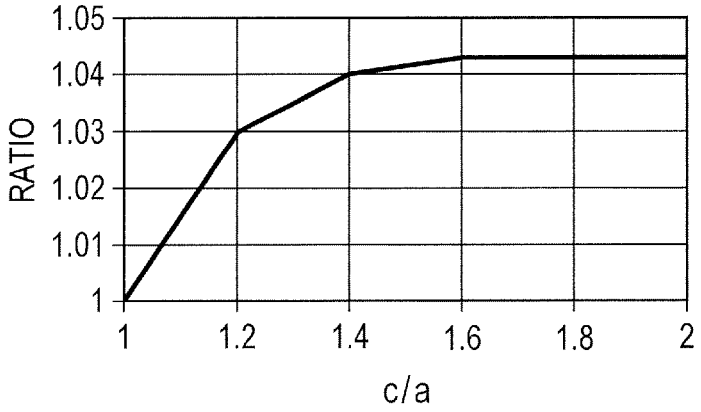
FIG. 6 is a graph illustrating results of measurement of an amount of displacement of a partition.

FIG. 6 is a graph showing results of measurement of an amount of displacement of the partition. A horizontal axis in FIG. 6 denotes a ratio of a height "c" of the wall surface 44 on the lower side of the side wall 10 of the partition 4 to a height "a" of the wall surface 43 on the lower side of the side wall 9 of the partition 4. A vertical axis in FIG. 6 denotes a ratio of the amount of displacement, provided that the amount of displacement in the liquid ejection device according to the reference example is 1.

As can be seen from FIG. 6, in a range in which a value of (c/a) is 1.4 or more, the ratio of the amount of displacement is 1.04 or more.

Therefore, by setting the height "a" of the wall surface 43 and the height "c" of the wall surface 44 so that the value of (c/a) is 1.4 or more, the amount of displacement of the partition 4 can be sufficiently improved. Specifically, by setting the height "c" of the wall surface 44 on the lower side of the side wall 10 of the partition 4 to be 1.4 times or more as much as the height "a" of the wall surface 43 on the lower side of the side wall 9 of the partition 4, the amount of displacement of the partition 4 can be sufficiently improved.

(Method of Manufacturing Liquid Ejection Device)

Next, a method of manufacturing the liquid ejection device according to this embodiment is described. FIG. 7 to FIG. 10 are process sectional views illustrating the method of manufacturing the liquid ejection device according to this embodiment.

First, the piezoelectric plate 1 is prepared. As a material of the piezoelectric plate 1, for example, a piezoelectric material such as piezoelectric ceramics is used. As the piezoelectric ceramics, for example, a ferroelectric lead zirconate titanate (PZT)-based ceramics material is used. Polarization treatment is applied to the piezoelectric plate 1 in a direction of, for example, the arrow D. The piezoelectric plate 1 has a thickness of, for example, about 1 mm.

Figure 7:
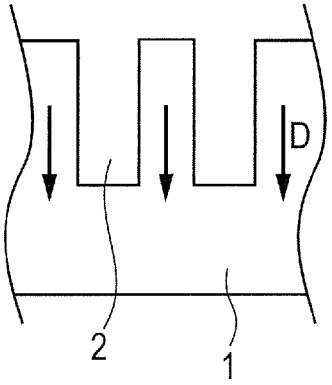
FIG. 7 is a process sectional view (No. 1) illustrating a method of manufacturing the liquid ejection device according to the second embodiment of the present invention.

Then, as illustrated in FIG. 7, a plurality of grooves 2 are formed in the piezoelectric plate 1 so as to be in parallel with one another. A depth direction of the grooves 2 is the same as, for example, the direction D of the polarization treatment applied to the piezoelectric plate 1. The grooves 2 can be formed using, for example, a diamond wheel. The grooves 2 have a depth of, for example, about 230 μm. A portion between the grooves 2 is to be the partition 4. The pitch of the grooves 2 is set so that the partition 4 has a thickness of, for example, 70 μm.

Figure 8:
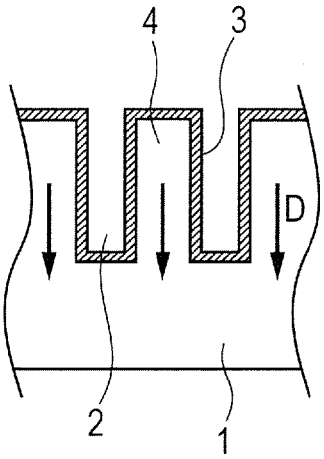
FIG. 8 is a process sectional view (No. 2) illustrating the method of manufacturing the liquid ejection device according to the second embodiment of the present invention.

Then, as illustrated in FIG. 8, a conductive film 3 is formed by, for example, vapor deposition or electroless plating. The conductive film 3 is to be the electrodes 3*a* and 3*b*. As a material of the conductive film 3, for example, a metal material such as aluminum or nickel is used.

Figure 9:
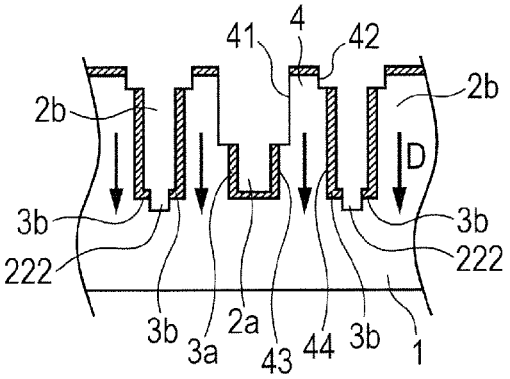
FIG. 9 is a process sectional view (No. 3) illustrating the method of manufacturing the liquid ejection device according to the second embodiment of the present invention.

Then, as illustrated in FIG. 9, grooves that are wider than the grooves 2 already formed are formed. In regions where the grooves 2*a* are to be formed, a depth of the wider grooves is set to be relatively large. In regions where the grooves 2*b* are to be formed, the depth of the wider grooves is set to be relatively small. In this way, the grooves 2*a* and the grooves 2*b* are formed. Further, the separating groove 222 may be formed in the bottom surface of the groove 2*b*. This separates the partial electrode 3*b* positioned on one side of the groove 2*b* and the partial electrode 3*b* positioned on the other side of the groove 2*b* from each other. The separating groove 222 is formed along the longitudinal direction of the groove 2*b* so as to extend from one end of the groove 2*b* to reach the other end thereof.

Then, the conductive film 3 remaining on upper surfaces of the partitions 4 is removed by lapping (rough polishing) or the like.

Figure 10:
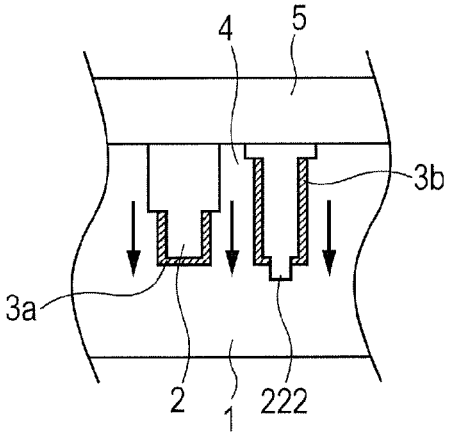
FIG. 10 is a process sectional view (No. 4) illustrating the method of manufacturing the liquid ejection device according to the second embodiment of the present invention.

Then, as illustrated in FIG. 10, the cover plate 5 is mounted onto the piezoelectric plate 1. It is preferred to use, as the cover plate 5, for example, a material having a coefficient of thermal expansion equivalent to that of the piezoelectric plate 1. In this case, as a material of the cover plate 5, the same material as that of the piezoelectric plate 1 is used. A liquid introduction port 11 (see FIG. 1) is formed in the cover plate 5. Further, a manifold 12 (see FIG. 1) is formed in the cover plate 5. An upper surface of the piezoelectric plate 1 and a lower surface of the cover plate 5 are bonded together with, for example, an epoxy-based adhesive (not shown).

Then, the orifice plate (nozzle plate) 7 (see FIG. 1) is mounted on an end surface of the piezoelectric plate 1. The orifice plate 7 is formed of, for example, plastic. Positions of nozzles 6 formed in the orifice plate 7 are positions corresponding to those of the pressure chambers 2*a*. The orifice plate 7 is bonded to the end surface of the piezoelectric plate 1 with, for example, an epoxy-based adhesive (not shown).

In this way, the liquid ejection device according to this embodiment is manufactured.

As described above, in this embodiment, not only the wall surface 41 is positioned so as to be set back from the wall surface 43 in the direction of the normal to the wall surface 41, but also the wall surface 42 is positioned so as to be set back from the wall surface 44 in the direction of the normal to the wall surface 42. Therefore, in this embodiment, an upper portion of the partition 4 is reduced in thickness. Therefore, in this embodiment, the partition 4 is more easily displaced. Because of this, according to this embodiment, the partition 4 can be more easily displaced in the shear mode, and the efficiency of displacing the partition 4 can be further improved.

[Evaluation Results]

Next, results of evaluation of the liquid ejection device according to the above-mentioned embodiment are described in the following.

Examples 1 to 3

Liquid ejection devices according to Examples 1 to 3 had the structure as illustrated in FIG. 2. In each of Examples 1 to 3, the partition 4 had a height of 230 μm. In Example 1, the height of the wall surface 43 was 25% of the height of the side wall 9. Specifically, in Example 1, the height of the wall surface 43 was 58 μm. In Example 2, the height of the wall surface 43 was 50% of the height of the side wall 9. Specifically, in Example 2, the height of the wall surface 43 was 115 μm. In Example 3, the height of the wall surface 43 was 65% of the height of the side wall 9. Specifically, in Example 3, the height of the wall surface 43 was 150 μm. In each of Examples 1 to 3, the height of the wall surface 44 was 230 μm. Further, in each of Examples 1 to 3, the wall surface 41 was set back by 10 μm from the wall surface 43 in the direction of the normal to the wall surface 41. A thickness of a portion of the partition 4 on the lower side, that is, a dimension between the wall surface 43 and the wall surface 44, was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection devices according to Examples 1 to 3 were manufactured.

Examples 4 and 5

Liquid ejection devices according to Examples 4 and 5 had the structure as illustrated in FIG. 5. In each of Examples 4 and 5, the partition 4 had a height of 230 μm. Further, in each of Examples 4 and 5, the height of the wall surface 43 was 115 μm. In Example 4, the height of the wall surface 44 was 1.4 times as much as the height of the wall surface 43. Specifically, in Example 4, the height of the wall surface 44 was 161 μm. In Example 5, the height of the wall surface 44 was 1.7 times as much as the height of the wall surface 43. Specifically, in Example 5, the height of the wall surface 44 was 196 μm. Further, in each of Examples 4 and 5, the wall surface 41 was set back by 10 μm from the wall surface 43 in the direction of the normal to the wall surface 41. The thickness of the portion of the partition 4 on the lower side, that is, the dimension between the wall surface 43 and the wall surface 44, was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection devices according to Examples 4 and 5 were manufactured.

Examples 6 and 7

Liquid ejection devices according to Examples 6 and 7 had the structure as illustrated in FIG. 2. In each of Examples 6 and 7, the partition 4 had a height of 230 μm. In each of Examples 6 and 7, the height of the wall surface 43 was 50% of the height of the side wall 9. Specifically, in each of Examples 6 and 7, the height of the wall surface 43 was 115 μm. In each of Examples 6 and 7, the height of the wall surface 44 was 230 μm. In Example 6, the thickness of the portion of the partition 4 on the upper side was 45 μm. In Example 7, the thickness of the portion of the partition 4 on the upper side was 30 μm. In each of Examples 6 and 7, the thickness of the portion of the partition 4 on the lower side was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection devices according to Examples 6 and 7 were manufactured.

Comparative Examples 1 and 2

Liquid ejection devices according to Comparative Examples 1 and 2 had the structure as illustrated in FIG. 2. In each of Comparative Examples 1 and 2, the partition 4 had a height of 230 μm. In Comparative Example 1, the height of the wall surface 43 was 20% of the height of the side wall 9. Specifically, in Comparative Example 1, the height of the wall surface 43 was 46 μm. In Comparative Example 2, the height of the wall surface 43 was 70% of the height of the side wall 9. Specifically, in Comparative Example 2, the height of the wall surface 43 was 161 μm.

In each of Comparative Examples 1 and 2, the height of the wall surface 44 was 230 μm. Further, in each of Comparative Examples 1 and 2, the wall surface 41 was set back by 10 μm from the wall surface 43 in the direction of the normal to the wall surface 41. The thickness of the portion of the partition 4 on the lower side, that is, the dimension between the wall surface 43 and the wall surface 44, was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection devices according to Comparative Examples 1 and 2 were manufactured.

Comparative Example 3

A liquid ejection device according to Comparative Example 3 had the structure as illustrated in FIG. 3. The partition 4 had a height of 230 μm. Further, the height of the wall surface 43 was 115 μm. The height of the wall surface 44 was the same as the height of the wall surface 43. Specifically, the height of the wall surface 44 was 115 μm. The wall surface 41 was set back by 10 μm from the wall surface 43 in the direction of the normal to the wall surface 41. The thickness of the portion of the partition 4 on the lower side, that is, the dimension between the wall surface 43 and the wall surface 44, was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection device according to Comparative Example 3 was manufactured.

Comparative Examples 4 and 5

Liquid ejection devices according to Comparative Examples 4 and 5 had the structure as illustrated in FIG. 3. In each of Comparative Examples 4 and 5, the partition 4 had a height of 230 μm. Further, in each of Comparative Examples 4 and 5, the height of the wall surface 43 was 115 μm. In each of Comparative Examples 4 and 5, the height of the wall surface 44 was 230 μm. In Comparative Example 4, the wall surfaces 41 and 42 were set back by 5 μm from the wall surfaces 43 and 44, respectively, in the direction of the normal to the wall surface 41 and 42. In Comparative Example 5, the thickness of the portion of the partition 4 on the upper side was 20 μm. Comparative Example 5, the wall surface 42 was set back by 20 μm from the wall surface 44 in the direction of the normal to the wall surface 42. The thickness of the portion of the partition 4 on the lower side, that is, the dimension between the wall surface 43 and the wall surface 44, was 70 μm. The conductive film 3 remaining on the upper surface of the partition 4 was removed by lapping, and the cover plate 5 formed of the same material as that of the piezoelectric plate 1 was bonded onto the piezoelectric plate 1. The orifice plate 7 having the plurality of nozzles 6 formed therein, which corresponded to the respective ink channels 2*a*, was bonded to the end surface of the piezoelectric plate 1. In this way, the liquid ejection devices according to Comparative Examples 4 and 5 were manufactured.

Table 1 shows results of evaluation of the liquid ejection devices manufactured as described above. With reference to the amount of displacement in the case of Comparative Example 3, the ratios of the amount of displacement to the amount of displacement in the case of Comparative Example 3 are shown. When the evaluation was made, a sinusoidal wave of 1 kHz and ±5 V was applied between the electrodes 3*a* and 3*b*. A maximum displacement of the partition 4 was measured using a laser displacement gauge.

TABLE 1

| | Amount of displacement (nm/10 V) | Ratio to amount of displacement in Comparative Example 3 |
|---|---|---|
| Example 1 | 4.4 | 1.02 |
| Example 2 | 5.1 | 1.19 |
| Example 3 | 4.4 | 1.02 |
| Example 4 | 4.5 | 1.05 |
| Example 5 | 4.5 | 1.05 |
| Example 6 | 6.0 | 1.40 |
| Example 7 | 7.5 | 1.74 |
| Comparative Example 1 | 4.0 | 0.93 |
| Comparative Example 2 | 4.0 | 0.93 |

TABLE 1-continued

| | Amount of displacement (nm/10 V) | Ratio to amount of displacement in Comparative Example 3 |
|---|---|---|
| Comparative Example 3 | 4.3 | 1.00 |
| Comparative Example 4 | Unable to prepare sample due to difficulty in processing | — |
| Comparative Example 5 | Unable to make measurement due to crack in sample | — |

As can be seen from Table 1, in each of the cases of Examples 1 to 7, the amount of displacement is larger than that in the case of Comparative Example 3.

From this, it can be seen that, according to the liquid ejection devices according to the first and second embodiments described above, the efficiency of displacing the partition 4 may be improved with reliability. Therefore, according to the liquid ejection devices according to the first and second embodiments, dielectric loss, an amount of produced heat, and damage to the partition 4 are inhibited, and still a desired amount of displacement can be obtained. Therefore, according to the first and second embodiments, a satisfactory liquid ejection device with high reliability can be obtained.

Third Embodiment

Figure 11:
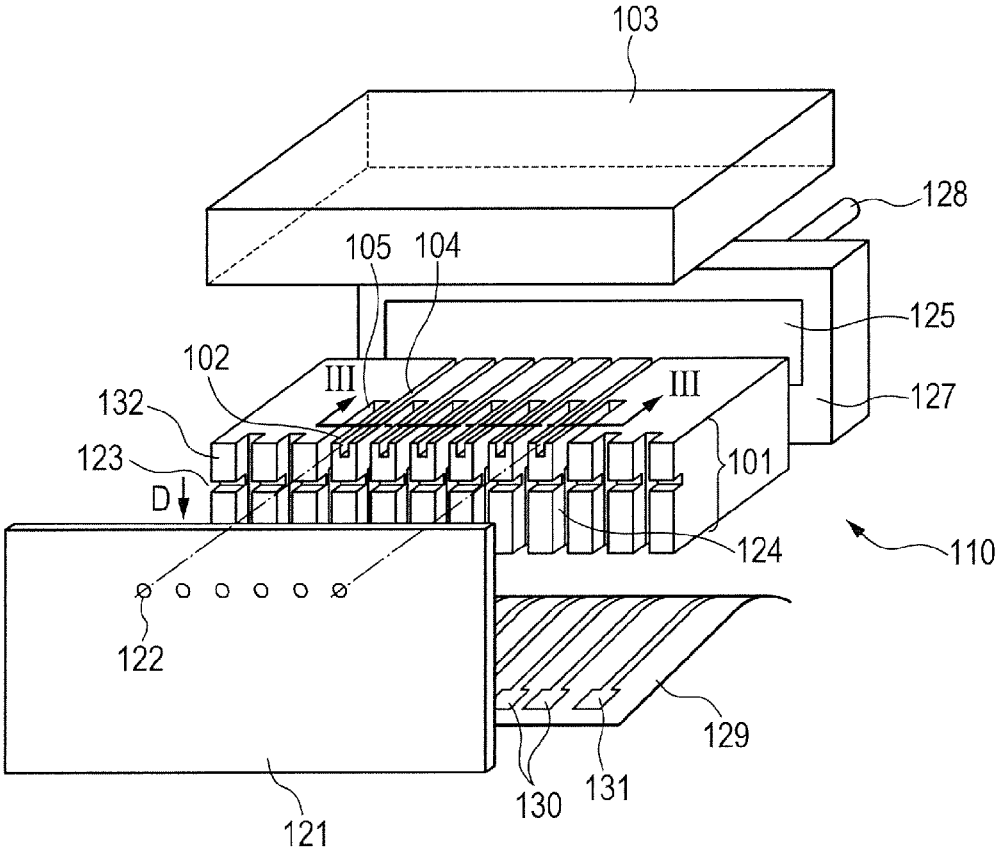
FIG. 11 is a perspective view schematically illustrating a liquid ejection device according to a third embodiment of the present invention.
Figure 12:
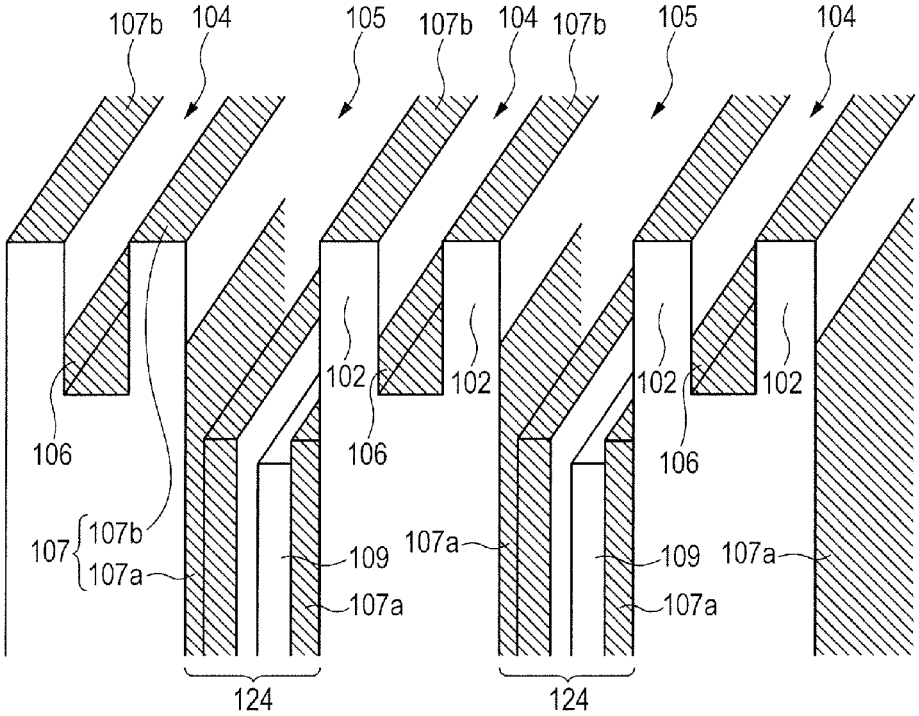
FIG. 12 is a perspective view illustrating a part of a piezoelectric transducer of the liquid ejection device according to the third embodiment of the present invention.
Figure 13A:
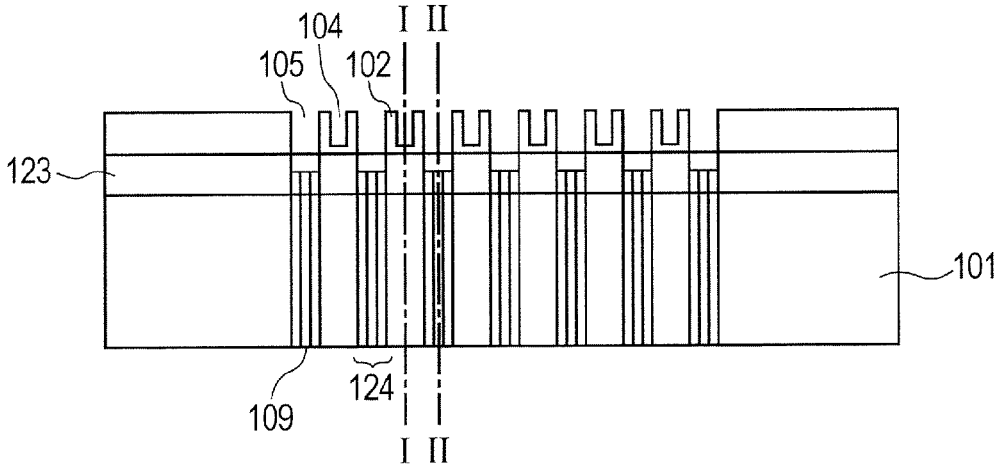
FIGS. 13A, 13B, and 13C are a front view and sectional views illustrating the piezoelectric transducer of the liquid ejection device according to the third embodiment of the present invention.
Figure 13B:
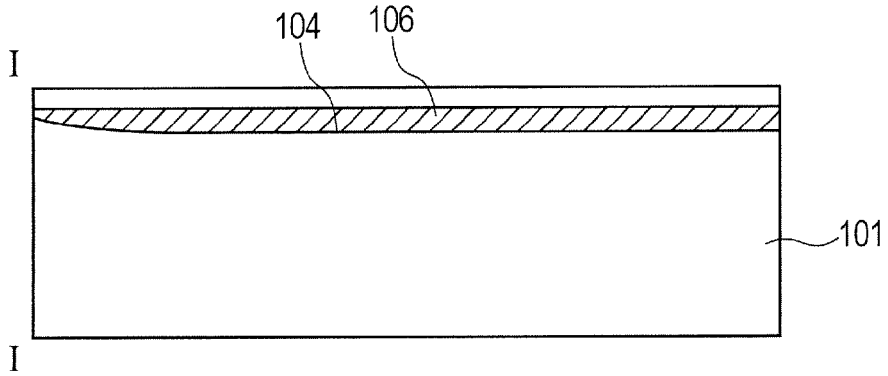
Figure 13C:
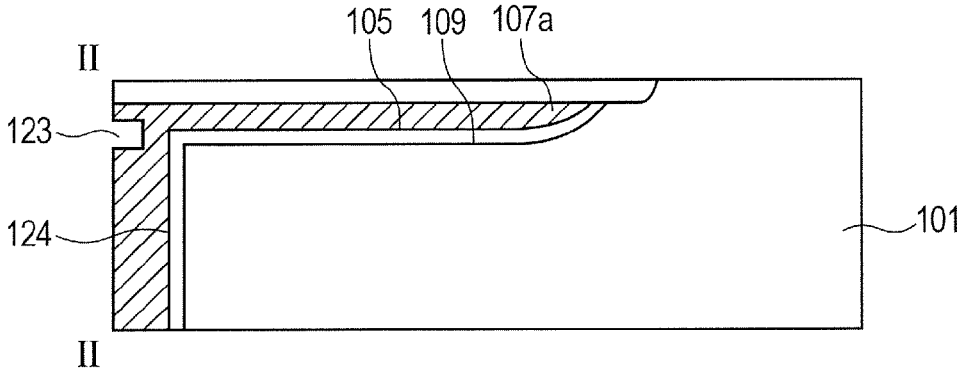
Figure 14A:
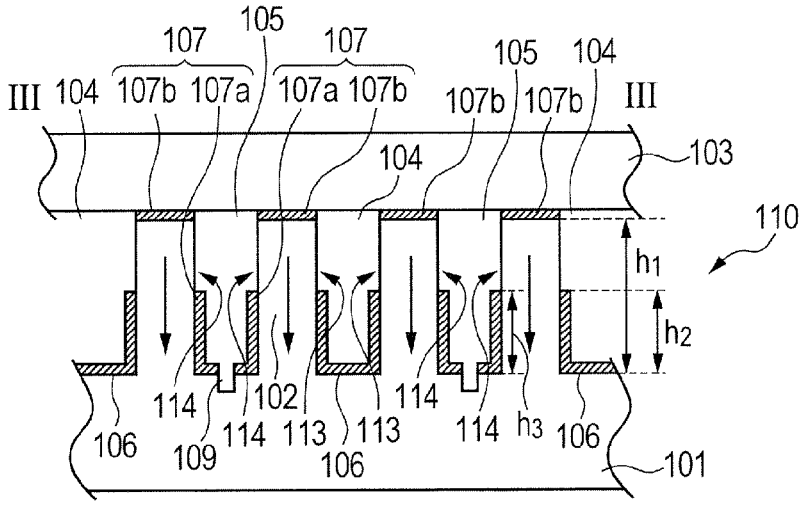
FIGS. 14A, 14B, and 14C are sectional views of the piezoelectric transducer of the liquid ejection device according to the third embodiment of the present invention.
Figure 14B:
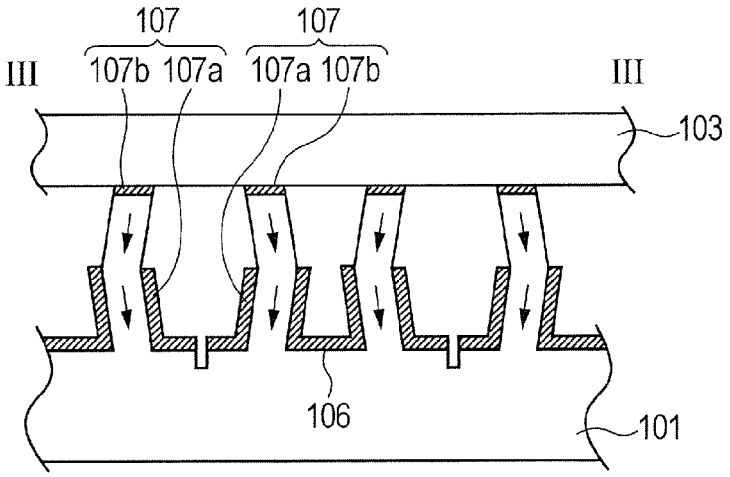
Figure 14C:
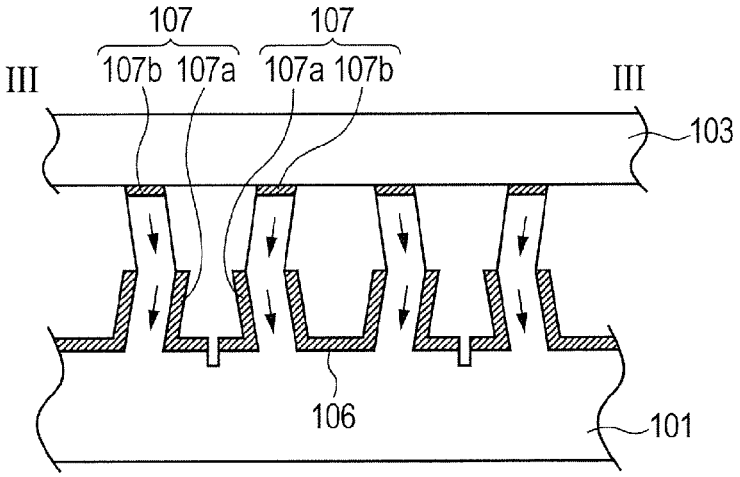

A liquid ejection device according to a third embodiment of the present invention is described with reference to the drawings. FIG. 11 is a perspective view schematically illustrating the liquid ejection device according to this embodiment. FIG. 12 is a perspective view illustrating a part of a piezoelectric transducer of the liquid ejection device according to this embodiment. FIGS. 13A, 13B, and 13C are a front view and sectional views illustrating the piezoelectric transducer of the liquid ejection device according to this embodiment. FIG. 13A is a front view of the piezoelectric transducer, FIG. 13B is a sectional view corresponding to the line I-I of FIG. 13A, and FIG. 13C is a sectional view corresponding to the line II-II of FIG. 13A. FIGS. 14A, 14B, and 14C are sectional views of the piezoelectric transducer of the liquid ejection device according to this embodiment. FIGS. 14A, 14B, and 14C correspond to sectional views taken along the line III-III of FIG. 11.

As illustrated in FIG. 11, the liquid ejection device according to this embodiment includes a piezoelectric transducer (actuator) 110 including a piezoelectric plate 101 and a cover plate (top plate) 103 mounted onto the piezoelectric plate 101. Further, the liquid ejection device according to this embodiment includes an orifice plate (nozzle plate) 121 mounted to a front surface side of the piezoelectric transducer 110 and a manifold 127 arranged on a back surface side of the piezoelectric transducer 110. Further, the liquid ejection device according to this embodiment includes a flexible substrate 129 for supplying power, which is mounted to a lower surface side of the piezoelectric transducer 110.

As a material of the piezoelectric plate 101, a piezoelectric material is used. As such a piezoelectric material, for example, piezoelectric ceramics is used. As the piezoelectric ceramics, for example, a lead zirconate titanate (PZT: $PbZr_xTi_{1-x}O_3$)-based ceramics material, which is a ferroelectric ceramics material. Note that, as the piezoelectric ceramics for forming the piezoelectric plate 101, there may be used, for example, barium titanate ($BaTiO_3$) and lanthanum-substituted lead zirconate titanate (PLZT: (Pb,La) $(Zr,Ti)O_3$). Polarization treatment is applied to the piezoelectric plate 101 in a direction of, for example, the arrow D. The piezoelectric plate 101 has a thickness of, for example, about 1 mm.

A plurality of grooves (openings) 104 and 105 are formed in the piezoelectric plate 101 so as to be in parallel with one another. The grooves 104 and the grooves 105 are alternately formed. The grooves 104 are formed for the purpose of forming pressure chambers (liquid channels). The grooves 105 are formed for the purpose of forming dummy pressure chambers, that is, dummy chambers.

A portion of the piezoelectric plate 101 between the groove 104 and the groove 105 is a partition 102. Each of the partitions 102 separates the pressure chamber 104 and the pressure chamber 105 from each other. As illustrated in FIG. 14A, each of the partitions 102 has a side wall 113 and a side wall 114 positioned on a back surface side of the side wall 113. The side wall 113 faces the groove 104, while the side wall 114 faces the groove 105. The side wall 113 of one partition 102 and the side wall 113 of another partition 102 adjacent to the one partition 102 are opposed to each other. Further, the side wall 114 of one partition 102 and the side wall 114 of another partition 102 adjacent to the one partition 102 are opposed to each other.

An electrode (drive electrode) 106 is formed in the groove 104. The electrode 106 is used for applying, in combination with an electrode 107 to be described later, the partition (piezoelectric material) 102 with an electric field in a direction perpendicular to the polarization direction D to displace the partition 102 in the shear mode. The electrode 106 is formed on lower portions of the side walls 113 and a bottom surface of the groove 104. A height $h_2$ of the electrode 106 (height from the bottom surface of the groove 104 to an upper end of the electrode 106) is, for example, about half as much as a height $h_1$ of the partition 102 (height from the bottom surface of the groove 104 to an upper surface of the partition 102). Note that, the height $h_2$ of the electrode 106 is not limited thereto, and may be appropriately set so that the partition 102 is sufficiently displaced. The electrode 106 is, for example, connected to a ground potential GND.

A partial electrode 107*a* forming a part of the electrode 107 is formed in the groove 105. The partial electrode 107*a* is formed on a lower portion of the side wall 114 and a bottom surface of the groove 105. A height $h_3$ of the partial electrode 107*a* (height from the bottom surface of the groove 105 to an upper end of the partial electrode 107*a*) is, for example, about half as much as the height $h_1$ of the partition 102 (height from the bottom surface of the groove 105 to the upper surface of the partition 102). Note that, the height $h_3$ of the partial electrode 107*a* is not limited thereto, and may be appropriately set so that the partition 102 is sufficiently displaced. The partial electrode 107*a* positioned on one side of the groove 105 and the partial electrode 107*a* positioned on the other side of the groove 105 are separated from each other by a separating groove 109 formed in the bottom surface of the groove 105. The separating groove 109 is formed along a longitudinal direction of the groove 105 so as to extend from one end of the groove 105 to reach the other end thereof. Further, the separating groove 109 is also formed in a groove 124 to be described later (see FIG. 12 and FIGS. 13A, 13B, and 13C). As described later, the groove 124 is used for the purpose of forming an extracting electrode 107*a* extracted from the partial electrode 107*a*. The separating groove 109 formed in the groove 124 is formed so as to extend from an upper end of the groove 124 to reach a lower end thereof.

A partial electrode 107*b* forming a part of the electrode 107 is formed on the upper surface of the partition 102. The partial electrode 107*b* formed on the upper surface of the partition 102 positioned on one side of the groove 105 and the partial electrode 107*a* positioned on the one side of the groove 105 are electrically connected to each other in a region (not shown). The partial electrode 107*b* formed on the upper surface of the partition 102 positioned on the other side of the groove 105 and the partial electrode 107*a* positioned on the other side of the groove 105 are electrically connected to each other in a region (not shown). For example, a signal voltage (control voltage, control signal) for applying an electric field of desired intensity to the partition 102 is applied to the electrode 107 including the partial electrode 107*a* and the partial electrode 107*b*. The electrode 107 positioned on one side of the groove 105 and the electrode 107 positioned on the other side of the groove 105 are electrically separated from each other, and thus, different signal voltages can be applied to the electrode 107 positioned on the one side of the groove 105 and to the electrode 107 positioned on the other side of the groove 105.

The groove 124 for forming the extracting electrode 107*a* extracted from the partial electrode 107*a* is formed in an end surface of the piezoelectric plate 101 on a front surface side, that is, an end surface of the piezoelectric plate 101 on a side to which the orifice plate 121 is mounted (see FIG. 12). The groove 124 extends in a direction of a normal to a principal plane of the piezoelectric plate 101 (see FIG. 11 and FIG. 12).

An escape groove 123 for allowing, when the orifice plate 121 and the piezoelectric plate 101 are bonded together, an adhesive (not shown) overflowing from a bonded surface 132 to flow into the escape groove 123 is formed in the end surface of the piezoelectric plate 101 on the front surface side. Such an escape groove 123 is formed so as to be along a direction within the principal plane of the piezoelectric plate 101, and intersects the groove 124 for forming the extracting electrode 107*a* (see FIG. 11).

The cover plate 103 is mounted onto the piezoelectric plate 101. It is preferred to use, as the cover plate 103, for example, a material having a coefficient of thermal expansion equivalent to that of the piezoelectric plate 101. In this case, as a material of the cover plate 103, the same material as that of the piezoelectric plate 101 is used. An upper surface of the piezoelectric plate 101 and a lower surface of the cover plate 103 are bonded together with, for example, an epoxy-based adhesive (not shown). The cover plate 103 is positioned above the grooves 104 and 105, and thus, portions where the grooves 104 and 105 are formed are pressure chambers. Note that, the portions where the grooves 104 are formed are to be pressure chambers 104, and thus, the grooves 104 and the pressure chambers 104 are described using the same reference numeral "104". Further, portions where the grooves 105 are formed are to be pressure chambers (dummy chambers) 105, and thus, the grooves 105 and the pressure chambers (dummy chambers) 105 are described using the same reference numeral "105".

The pressure chamber 104 and the pressure chamber 105 adjacent to the pressure chamber 104 are separated from each other by the same partition 102. Therefore, it is not necessarily easy to independently control a capacity of the pressure chamber 104 and a capacity of the pressure chamber 105 adjacent to the pressure chamber 104. Therefore, the pressure chamber 104 is used as a liquid channel, and the pressure chamber 105 adjacent to the pressure chamber 104 is used as a dummy.

It is also possible to control the capacities of the respective pressure chambers 104 and 105 so that the pressure chambers 105 can also be used as liquid channels. For example, the electrode 106 formed on the partition 102 on one side of the pressure chamber 104 and the electrode 106 formed on the partition 102 on the other side of the pressure chamber 104 are separated from each other, and different signal voltages are applied to those electrodes 106. It is thus possible to use not only the pressure chambers 104 but also the pressure chambers 105 as liquid channels.

In this case, a case in which the pressure chambers 105 are not used as liquid channels is described as an example.

As illustrated in FIG. 13B, in a region except for the vicinity of the end surface of the piezoelectric plate 101 on the front surface side, the pressure chambers 104 are set to have a fixed depth. On the other hand, in the vicinity of the end surface of the piezoelectric plate 101 on the front surface side, the pressure chambers 104 have a depth that gradually reduces.

The dummy chambers 105 are formed so as not to reach an end surface of the piezoelectric plate 101 on a back surface side, that is, an end surface of the piezoelectric plate 101 to which the manifold 127 is mounted. This is for the purpose of preventing liquid from being supplied from the manifold 127 into the dummy chambers 105.

The manifold 127 is mounted on the back surface side of the piezoelectric transducer 110. The manifold 127 has a common liquid chamber 125 formed therein for supplying liquid (ink) to the pressure chambers 104 in the piezoelectric transducer 110. Liquid stored in a liquid bottle (not shown) is supplied into the manifold 127 through an ink supply port 128 formed on a back surface side of the manifold 127. Further, an ink discharge port (not shown) is also formed on the back surface side of the manifold 127. The ink supply port 128 and the ink discharge port are formed in the manifold 127, and thus, ink can circulate in the manifold 127.

The orifice plate 121 is mounted on the front surface side of the piezoelectric plate 101. The orifice plate 121 is formed of, for example, plastic. Nozzles 122 are formed in the orifice plate 121 at positions corresponding to those of the pressure chambers (liquid channels) 104. The orifice plate 121 is bonded to an end surface of the piezoelectric transducer 110 with, for example, an epoxy-based adhesive (not shown).

The flexible substrate 129 is mounted on a lower surface side of the piezoelectric plate 101. Wiring having terminals 130 and wiring having terminals 131 are formed on the flexible substrate 129. The terminals 131 are electrically connected to the electrodes 106 formed in the pressure chambers 104, respectively. The terminals 130 are electrically connected to the electrodes 107 formed in the dummy chambers 105 and on the partitions 102. A signal voltage is individually applied to each of the terminals 130. The terminals 131 are, for example, connected to the ground potential GND.

FIG. 14B and FIG. 14C are sectional views illustrating operation of the piezoelectric transducer of the liquid ejection device according to this embodiment.

FIG. 14B illustrates a case in which a signal voltage of a certain polarity, that is, a signal voltage of a first polarity is applied to the electrodes 107. When a signal voltage of the first polarity is applied to the electrodes 107, the partitions 102 are displaced in the shear mode so that the capacities of the pressure chambers 104 are reduced. As illustrated in FIG. 14B, the capacities of the pressure chambers 104 are reduced, but the capacities of the dummy chambers 105 are increased.

FIG. 14C illustrates a case in which a signal voltage of a second polarity opposite to the first polarity is applied to the electrodes 107. When a signal voltage of the second polarity is applied to the electrodes 107, the partitions 102 are displaced in the shear mode so that the capacities of the pressure chambers 104 are increased. As illustrated in FIG. 14C, the capacities of the pressure chambers 104 are increased, but the capacities of the dummy chambers 105 are reduced.

In this way, in the liquid ejection device according to this embodiment, by changing the capacity of the pressure chamber (liquid channel) 104, liquid can be ejected from the nozzle 122 (see FIG. 11).

Figure 15A:
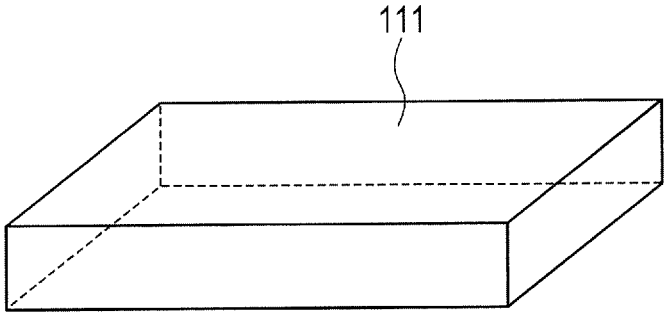
FIGS. 15A, 15B, and 15C are process views (No. 1) illustrating a method of manufacturing the liquid ejection device according to the third embodiment of the present invention.
Figure 15B:
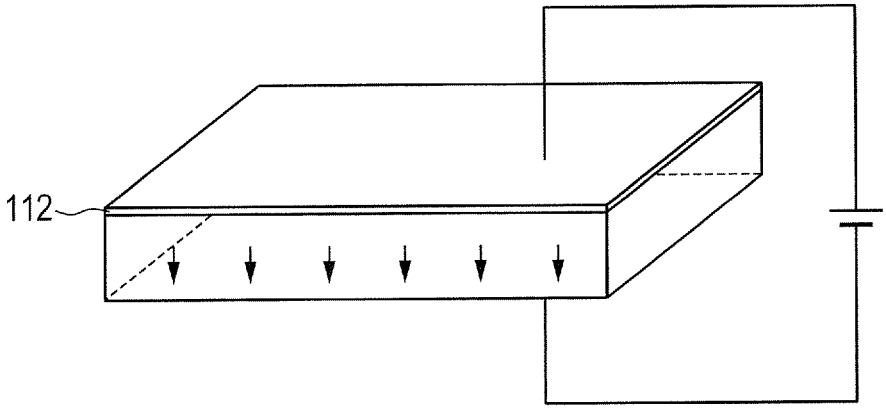
Figure 15C:
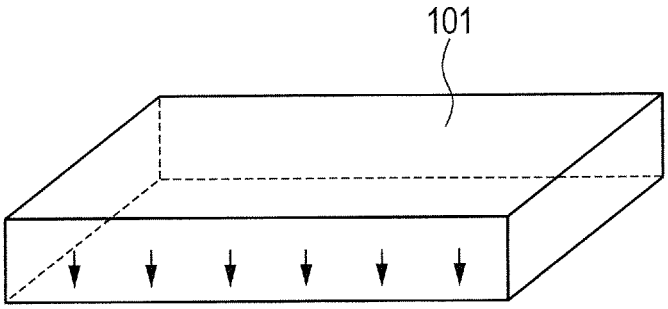
Figure 16A:
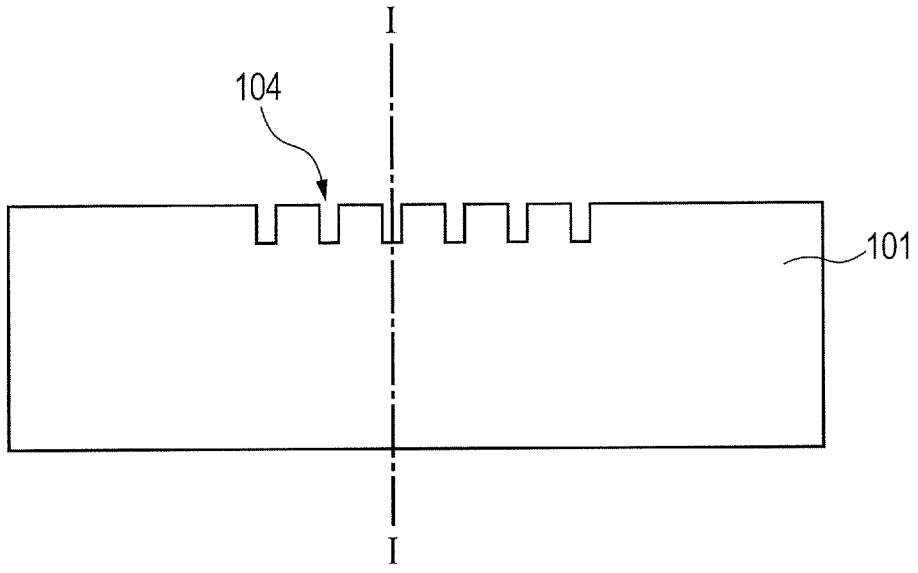
FIGS. 16A and 16B are process views (No. 2) illustrating the method of manufacturing the liquid ejection device according to the third embodiment of the present invention.
Figure 16B:
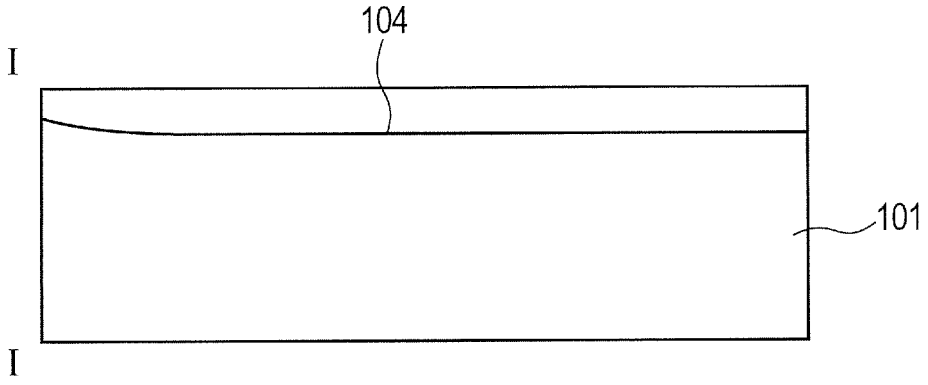
Figure 17A:
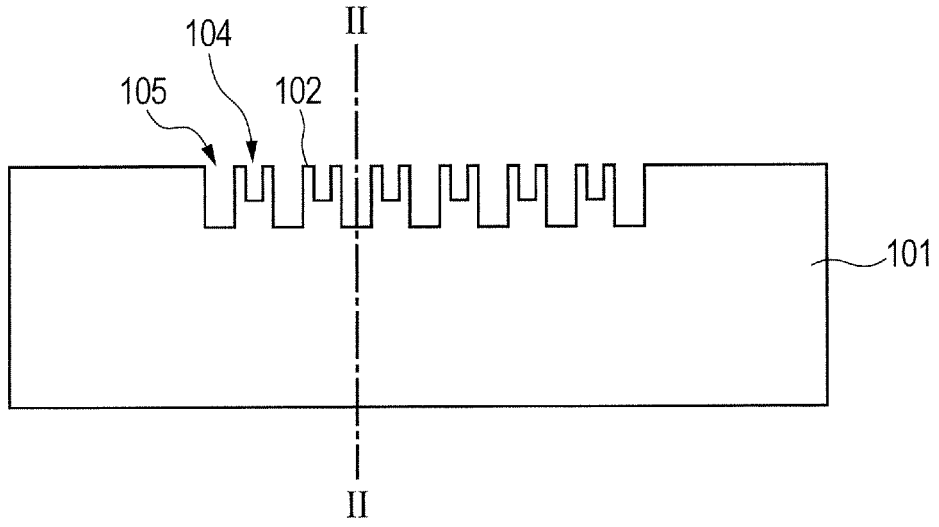
FIGS. 17A and 17B are process views (No. 3) illustrating the method of manufacturing the liquid ejection device according to the third embodiment of the present invention.
Figure 17B:
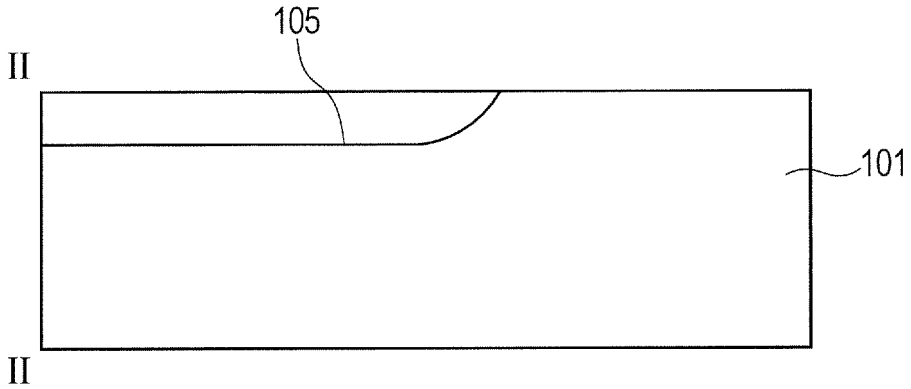
Figure 18A:
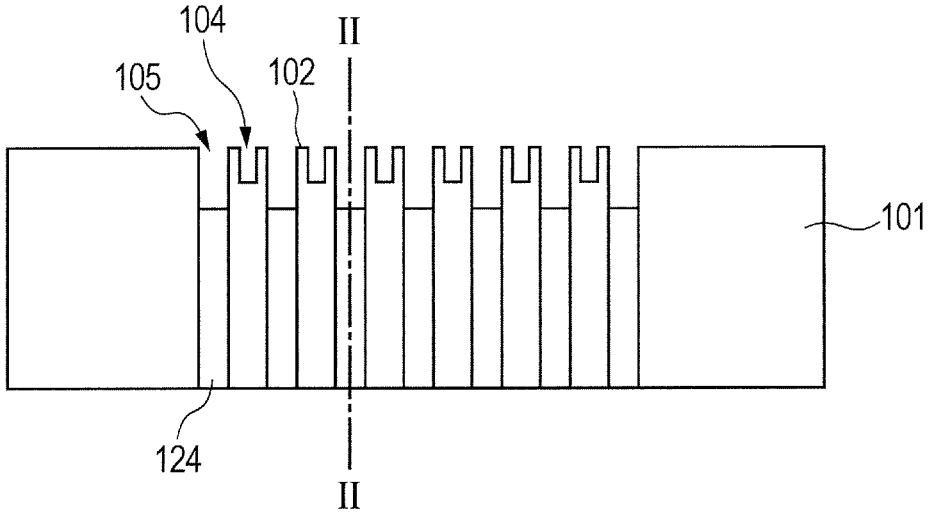
FIGS. 18A and 18B are process views (No. 4) illustrating the method of manufacturing the liquid ejection device according to the third embodiment of the present invention.
Figure 18B:
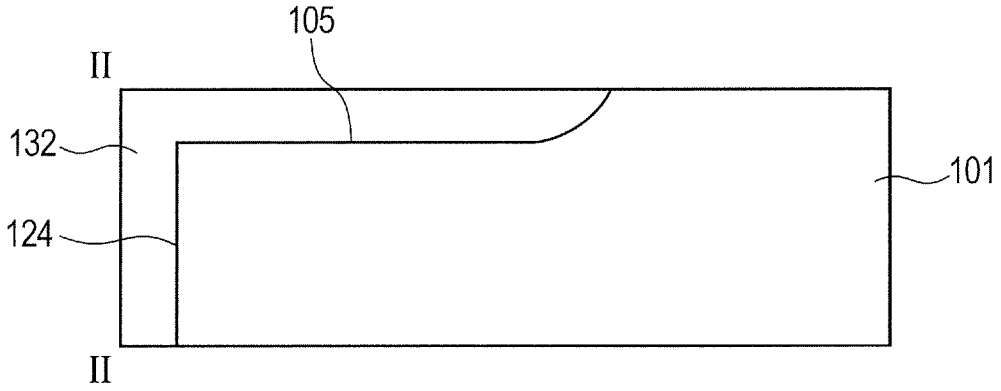
Figure 19A:
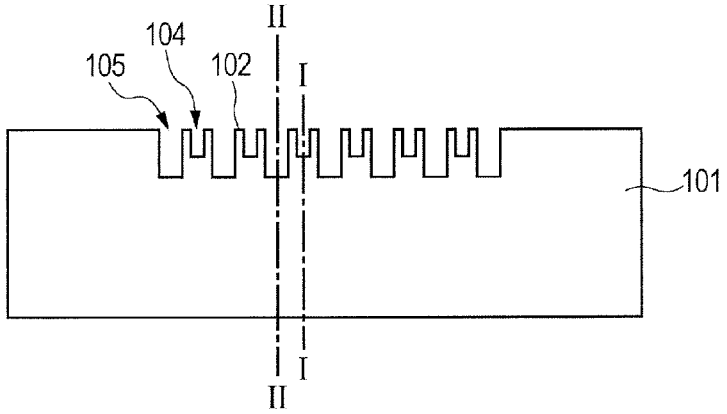
FIGS. 19A, 19B, 19C, and 19D are process views (No. 5) illustrating the method of manufacturing the liquid ejection device according to the third embodiment of the present invention.
Figure 19B:
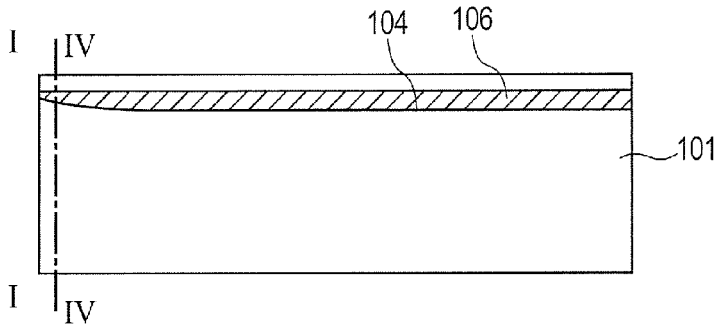
Figure 19C:
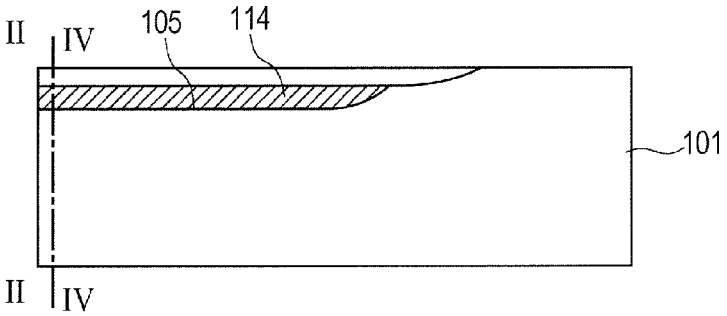
Figure 19D:
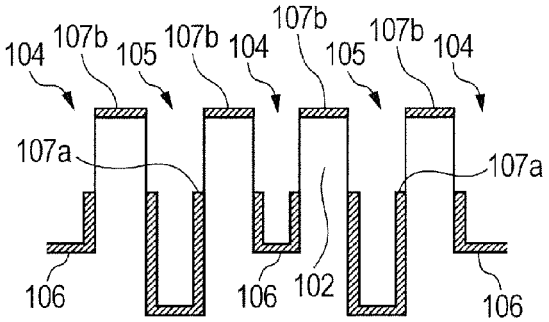
Figure 20A:
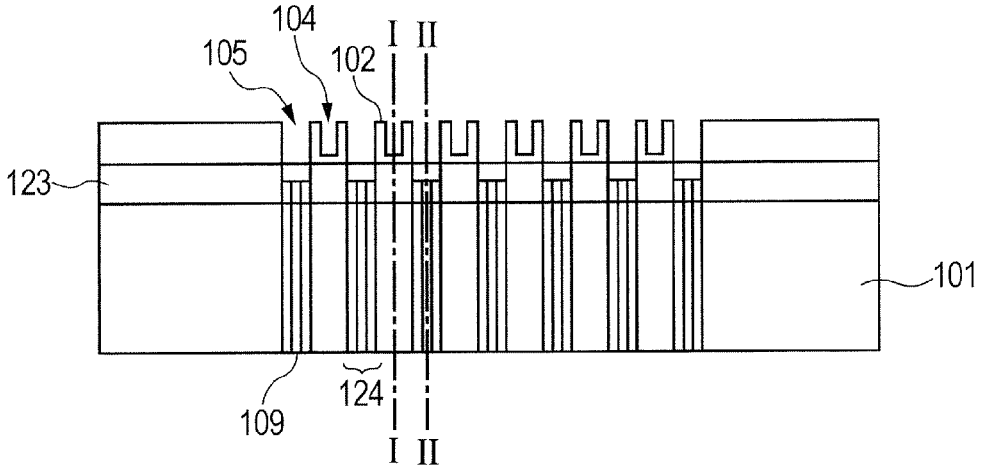
FIGS. 20A, 20B, and 20C are process views (No. 6) illustrating the method of manufacturing the liquid ejection device according to the third embodiment of the present invention.
Figure 20B:
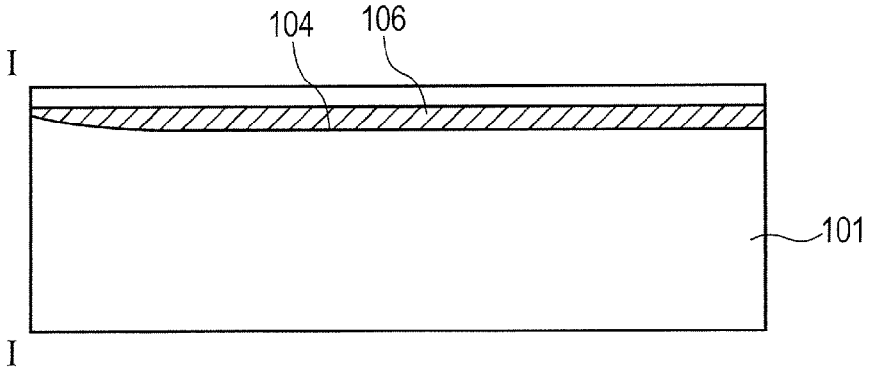
Figure 20C:
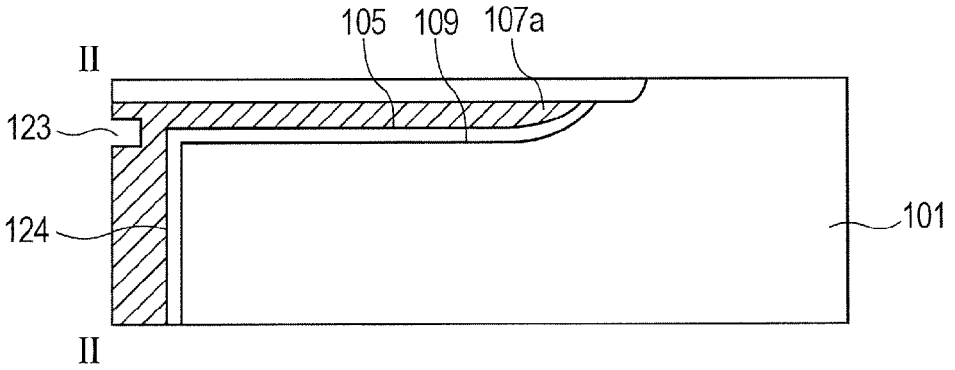
Figure 21:
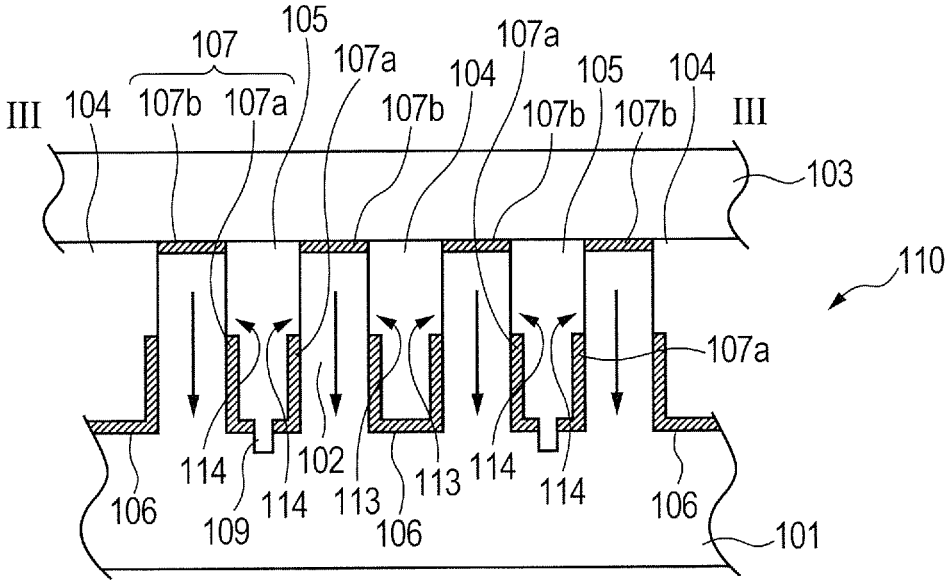
FIG. 21 is a process view (No. 7) illustrating the method of manufacturing the liquid ejection device according to the third embodiment of the present invention.

Next, a method of manufacturing the liquid ejection device according to this embodiment is described with reference to the drawings. FIG. 15A to FIG. 21 are process views illustrating the method of manufacturing the liquid ejection device according to this embodiment. FIG. 15A to FIG. 15C are perspective views. FIG. 16A is a front view, and FIG. 16B is a sectional view corresponding to the line I-I of FIG. 16A. FIG. 17A is a front view, and FIG. 17B is a sectional view corresponding to the line II-II of FIG. 17A. FIG. 18A is a front view, and FIG. 18B is a sectional view corresponding to the line II-II of FIG. 18A. FIG. 19A is a front view, FIG. 19B is a sectional view corresponding to the line I-I of FIG. 19A, FIG. 19C is a sectional view corresponding to the line II-II of FIG. 19A, and FIG. 19D is a sectional view corresponding to the line IV-IV of FIG. 19C. FIG. 20A is a front view, FIG. 20B is a sectional view corresponding to the line I-I of FIG. 20A, and FIG. 20C is a sectional view corresponding to the line II-II of FIG. 20A. FIG. 21 is a sectional view corresponding to the line III-III of FIG. 11.

First, as illustrated in FIG. 15A, an un-polarized piezoelectric plate 111 is prepared. As a material of the piezoelectric plate 111, for example, PZT, barium titanate, or PLZT is used. In this case, for example, PZT is used as the material of the piezoelectric plate 111. Then, the piezoelectric plate 111 is sintered. Next, the piezoelectric plate 111 is processed into a desired shape. Then, the piezoelectric plate 111 is processed by hot isostatic pressing (HIP). The HIP processing is a process of processing under a state in which a high temperature and an isotropic pressure are simultaneously applied to an object to be processed. The temperature during the HIP processing is, for example, 1,000° C. or higher. The pressure during the HIP processing is, for example, 1,000 atmospheres or higher. By performing the HIP processing, voids (air bubbles) in the piezoelectric plate 111 can be reduced. Then, the respective surfaces of the piezoelectric plate 111 are polished. In particular, it is preferred to polish the piezoelectric plate 111 so that an upper principal plane and a lower principal plane of the piezoelectric plate 111 are in parallel with each other.

Next, as illustrated in FIG. 15B, an electrode 112 for polarization treatment is formed on each of the upper principal plane and the lower principal plane of the piezoelectric plate 111. The electrode 112 for polarization treatment can be formed using, for example, silver (Ag) paste. The electrode 112 for polarization treatment has a thickness of, for example, about several micrometers. Then, by applying a voltage between the electrodes 112 for polarization treatment, polarization treatment of the piezoelectric plate 111 is performed. For example, a voltage to be applied between the electrodes 112 for polarization treatment is set so that an electric field of 2 kV/ram to 4 kV/ram is applied to the piezoelectric plate 111.

Then, as illustrated in FIG. 15C, the electrodes 112 for polarization treatment are removed. The electrodes 112 for polarization treatment can be removed by, for example, grinding or polishing. In this way, the polarized piezoelectric plate 101 is obtained. The arrows in FIGS. 15A, 15B, and 15C show a direction of the polarization. Note that, a size of the arrows is irrelevant to the extent of the polarization.

Then, as illustrated in FIGS. 16A and 16B, the grooves 104 for forming the pressure chambers (liquid channels) are formed in the piezoelectric plate 101 using a dicing blade (not shown). The plurality of grooves 104 are formed so as to be in parallel with one another. The dicing blade has a thickness (cutting edge width) of, for example, about 40 μm to 100 μm. In this case, the dicing blade has a thickness of, for example, about 50 μm. The dicing blade has a diameter of, for example, about 51 mm to 102 mm. In this case, the dicing blade has a diameter of, for example, about 64 mm. As the dicing blade, for example, a dicing blade containing diamond abrasive grains is used. The diamond grains have a grain size of, for example, about #1000 to #1600. In this case, the diamond grains have a grain size of, for example, about #1600. As a bond for fixing the diamond grains, for example, a resin bond is used. It is preferred to use, as a dicing apparatus, a dicing apparatus that can be at least biaxially controlled. In this case, as the dicing apparatus, for example, a dicing saw manufactured by DISCO Corporation (trade name: Fully Automatic Dicing Saw, model No: DAD6240, spindle type: 1.2 kW) is used. The dicing blade has a rotation speed of, for example, about 2,000 rpm to 30,000 rpm. In this case, the dicing blade has a rotation speed of, for example, about 20,000 rpm. It is preferred not to set a feeding speed of a stage that supports the piezoelectric plate 101 to be excessively high, in order to prevent the piezoelectric plate 101 from being excessively stressed when being processed using the dicing blade. The feeding speed of the stage is, for example, about 0.1 mm/s to 0.5 mm/s. In this case, the stage feeding speed is, for example, about 0.2 mm/s.

In the region except for the vicinity of the end surface of the piezoelectric plate 101 on the front surface side, the processing is performed so that the grooves 104 have a fixed depth. In the vicinity of the end surface of the piezoelectric plate 101 on the front surface side, the processing is performed so that the grooves 104 have a depth that gradually reduces (see FIG. 16B). The grooves 104 have a depth of, for example, about 230 μm to 400 μm in the region except for the vicinity of the end surface of the piezoelectric plate 101 on the front surface side. In this case, the grooves 104 have a depth of, for example, about 230 μm in the region except for the vicinity of the end surface of the piezoelectric plate 101 on the front surface side. The plurality of grooves 104 has a pitch of, for example, about 254 μm. The number of the grooves 104 is, for example, about 20. Note that, in the drawings, some of a large number of the grooves 104 formed are illustrated as a representative.

Then, as illustrated in FIGS. 17A and 17B, the grooves 105 for forming the dummy chambers are formed in the piezoelectric plate 101 using a dicing blade (not shown). As a dicing apparatus, for example, a dicing apparatus similar to the dicing apparatus used in forming the grooves 104 can be used. The grooves 105 are formed so as to be along a longitudinal direction of the grooves 104. The plurality of grooves 105 are formed so as to be in parallel with one another. Regions in which the grooves 105 are formed are set so that the plurality of grooves 105 are at the centers between the plurality of grooves 104 formed so as to be in parallel with one another, respectively. The dicing blade has a thickness (cutting edge width) of, for example, about 40 μm to 100 μm. In this case, the dicing blade has a thickness of, for example, about 64 μm. The dicing blade has a diameter of, for example, about 51 mm to 102 mm. In this case, similarly to the diameter of the dicing blade used in forming the grooves 104, the dicing blade has a diameter of, for example, about 64 mm. The diamond grains have a grain size of, for example, about #1000 to #1600. In this case, similarly to the diameter of the dicing blade used in forming the grooves 104, the diamond grains have a grain size of, for example, about #1600. The dicing blade has a rotation speed of, for example, about 2,000 rpm to 30,000 rpm. In this case, similarly to the rotation speed of the dicing blade in forming the grooves 104, the rotation speed of the dicing blade is, for example, about 20,000 rpm. A feeding speed of a stage that supports the piezoelectric plate 101 is, for example, about 0.1 mm/s to 0.5 mm/s. In this case, similarly to the feeding speed of the stage in forming the grooves 104, the stage feeding speed is, for example, about 0.2 mm/s. As illustrated in FIG. 17B, the grooves 105 are formed so as not to reach the end surface of the piezoelectric plate 101 on the back surface side. Specifically, the processing is performed so that the grooves 105 have a depth that gradually reduces on the back surface side of the piezoelectric plate 101. The grooves 105 are formed so as not to reach the end surface of the piezoelectric plate 101 on the back surface side for the purpose of preventing liquid from being supplied from the manifold 127 into the dummy chambers 105. In a region except for portions at which the grooves 105 have a depth that gradually reduces, the processing is performed so that the grooves 105 have a fixed depth. The depth of the grooves 105 is, for example, the same as that of the grooves 104. In this case, the grooves 105 have a depth of, for example, about 230 μm. Note that, the depth of the grooves 105 is not required to be the same as the grooves 104. For example, the depth of the grooves 105 may be appropriately set in a range of from 1 to 1.15 times as much as the depth of the grooves 104. A portion between the groove 104 and the groove 105 is the partition 102. The partition 102 is positioned on both sides of the pressure chamber formed by the groove 104. The partitions 102 have a thickness of, for example, about 50 μm to 90 μm. In this case, the partitions 102 have a thickness of, for example, about 70 μm.

Then, as illustrated in FIGS. 18A and 18B, the grooves 124 are formed in the end surface of the piezoelectric plate 101 on the front surface side using a dicing blade (not shown). The grooves 124 are formed so as to extend in the direction of the normal to the principal plane of the piezoelectric plate 101. The grooves 124 are formed for the purpose of forming the extracting electrodes 107*a* extracted from the partial electrodes 107*a*. Processing conditions in forming the grooves 124 are, for example, similar to processing conditions in forming the grooves 105. The grooves 124 have a depth of, for example, about 400 μm. The grooves 124 are formed on the front surface side of the piezoelectric plate 101, that is, on the left side of the sheet of FIG. 18B, so as to communicate to the grooves 105.

Then, a conductive film (not shown) covering an entire surface of the piezoelectric plate 101 is formed. Such a conductive film can be formed as described below.

First, by etching the surface of the piezoelectric plate 101, minute depressions (unevenness) are formed in the surface of the piezoelectric plate 101. Then, deleading treatment for removing from the surface of the piezoelectric plate 101 lead (Pb) contained in the material of the piezoelectric plate 101 is applied.

Next, as described below, a plated catalyst is deposited onto the surface of the piezoelectric plate 101. For example, tin (Sn) and palladium (Pd) are used as the plated catalyst. In this case, the deposition is described by way of the case where the plated catalyst of palladium is generated. First, the piezoelectric plate 101 is immersed into an aqueous solution of stannous chloride with a concentration of about 0.1%, thereby depositing stannous chloride onto the surface of the piezoelectric plate 101. Subsequently, the piezoelectric plate 101 is immersed into an aqueous solution of palladium chloride with a concentration of about 0.1%, thereby allowing an oxidation-reduction reaction between tin chloride, which is deposited onto the piezoelectric plate 101 in advance, and palladium chloride to occur to generate metallic palladium on the surface of the piezoelectric plate 101. Thus, the plated catalyst of metallic palladium is deposited onto the surface of the piezoelectric plate 101.

Next, the piezoelectric plate 101 in which metallic palladium is generated on its surface is immersed into, for example, a nickel plating bath, thereby generating an electroless plating film containing nickel (Ni) on the surface of the piezoelectric plate 101. For example, the following films are formed as the electroless plating film: an electroless plating film of nickel-phosphorus (Ni—P) and an electroless plating film of nickel-boron (Ni—B). It is preferred that a thickness of the electroless plating film be set to be about 0.5 μm to 1.0 μm for the purpose of sufficiently cover the surface of the piezoelectric plate 101 and sufficiently reducing electrical resistance. In this way, the electroless plating film is formed on the entire surface of the piezoelectric plate 101.

After that, for example, through replacement plating, a gold (Au) plating film, for example, is formed on the electroless plating film. In this way, the conductive film including the plating film is formed on the entire surface of the piezoelectric plate 101.

Then, unnecessary portions of the conductive film formed on the entire surface of the piezoelectric plate 101 are removed (see FIGS. 19A to 19D). The unnecessary portions of the conductive film can be removed as described below.

Portions of the conductive film on the front surface side and on the back surface side of the piezoelectric plate 101 are removed. The portions of the conductive film on the front surface side and on the back surface side of the piezoelectric plate 101 can be removed by, for example, polishing. An amount of polishing at the time when the portions of the conductive film on the front surface side and on the back surface side of the piezoelectric plate 101 are removed is, for example, about 5 μm.

Further, portions of the conductive film on upper portions of the side walls 113 and 114 of the partition 102 are removed. The portions of the conductive film on the upper portions of the side walls 113 and 114 of the partition 102 can be removed using, for example, a dicing blade. As the dicing apparatus, for example, a dicing apparatus similar to the dicing apparatus used in forming the grooves 104 and 105 can be used. As the dicing blade used in removing the unnecessary portions of the conductive film on the side walls 113 and 114, for example, a dicing blade having a thickness smaller than that of the dicing blade used in forming the grooves 104 and 105 can be used. When the unnecessary portion of the conductive film on the side wall 113 facing the groove 104 is removed, a dicing blade having a thickness of, for example, about 55 μm is used. When the unnecessary portion of the conductive film on the side wall 114 facing the groove 105 is removed, a dicing blade having a thickness of, for example, about 50 μm is used. In both of these cases, the dicing blade has a diameter of, for example, about 64 mm. Further, in both of those cases, diamond grains contained in the dicing blade have a grain size of, for example, about #1600. Such dicing blades are used and, under the state in which the position is adjusted using a stage (not shown), the portions of the conductive film on the upper portions of the side walls 113 and 114 of the partition 102 are ground to be removed. In both of those cases, the portions of the conductive film to be removed by grinding are portions of the conductive film positioned in a range from the upper surfaces of the partitions 102 to a depth of, for example, about 115 μm.

Note that, the dicing blade used in removing the unnecessary portions of the conductive film on the side walls 113 and 114 of the partition 102 is not limited to such a dicing blade. A dicing blade having a thickness larger than that of the dicing blade used in forming the grooves 104 and 105 may also be used. In this case, not only the unnecessary portions of the conductive film can be removed, but also an upper portion of the partition 102 can be decreased in thickness.

Further, it is also possible to remove the unnecessary portions of the conductive film on the side walls 113 and 114 of the partition 102 using a laser beam or the like. As the laser beam, for example, an excimer laser or a KrF laser is used. The laser beam has an energy density of, for example, about 1 J/cm$^2$ to 10 J/cm$^2$. Through scanning with the laser beam at an appropriate speed, the unnecessary portions of the conductive film can be removed.

In this way, the unnecessary portions of the conductive film on the surfaces of the piezoelectric plate 101 are removed to form the electrodes 106 and 107 in desired shapes.

Then, as illustrated in FIGS. 20A to 20C, the separating groove 109 is formed at the bottom of the groove 105 to be the dummy chamber and at the bottom of the groove 124 for the extracting electrode. The separating groove 109 is for the purpose of separating the partial electrode 107*a* positioned on one side of the groove 105 or 124 and the partial electrode 107*a* positioned on the other side of the groove 105 or 124 from each other. When the separating groove 109 is formed, similarly to the case in which the above-mentioned grooves 104, 105, and 124 are formed, a dicing blade is used, for example. The separating groove 109 has a width that is, for example, about ½ to ⅓ of the width of the groove 105 or 124. Note that, the width of the separating groove 109 is not limited thereto, and may be appropriately set. In this case, the dicing blade has a thickness of, for example, about 40 μm. The separating groove 109 has a depth of, for example, about 10 μm to 50 μm. In this case, the separating groove 109 has a depth of, for example, about 20 μm. The separating groove 109 is formed along the longitudinal direction of the groove 105 so as to extend from a front end of the groove 105 to reach a rear end thereof. Further, the separating groove 109 is formed along a longitudinal direction of the groove 124 so as to extend from the upper end of the groove 124 to reach the lower end thereof. The partial electrode 107*a* positioned on one side of the groove 105 or 124 and the partial electrode 107*a* positioned on the other side of the groove 105 or 124 are separated from each other, and thus, different signal voltages can be applied to those partial electrodes 107*a*. Therefore, the partitions 102 of the pressure chambers 104 can be individually displaced.

Further, the escape groove 123 is formed in the end surface of the piezoelectric plate 101 on the front surface side. As described above, the escape groove 123 is formed for allowing, when the orifice plate 121 and the piezoelectric plate 101 are bonded together, an adhesive (not shown) overflowing from the bonded surface 132 to flow into the escape groove 123. A longitudinal direction of the escape groove 123 is, for example, a direction along the direction within the principal plane of the piezoelectric plate 101. The escape groove 123 is formed so as to be positioned below openings of the pressure chambers 104 and 105. When the escape groove 123 is formed, the same dicing blade as the one used in forming the separating groove 109 can be used. The escape groove 123 has a depth of, for example, about 20 μm.

Further, a separating groove (not shown) is appropriately formed on a lower surface side of the piezoelectric plate 101. Such a separating groove is for the purpose of preventing a short circuit between the electrodes 106 and 107 through the conductive film existing on the lower surface side of the piezoelectric plate 101. Further, such a separating groove is for the purpose of preventing a short circuit between the terminals 130 and 131 and wiring patterns formed existing on the flexible substrate 129 through the conductive film on the lower surface side of the piezoelectric plate 101. Such a separating groove can be formed by, for example, scanning with a laser beam. As the laser beam, for example, an excimer laser or a KrF laser is used.

Then, the cover plate (top) 103 is mounted onto the piezoelectric plate 101 (see FIG. 11 and FIG. 21). It is preferred to use, as a material of the cover plate 103, for example, a material having a coefficient of thermal expansion equivalent to that of the piezoelectric plate 101. In this case, as the material of the cover plate 103, the same material as that of the piezoelectric plate 101 is used. In this case, as the material of the cover plate 103, for example, PZT is used. Note that, the material of the cover plate 103 is not limited to the same material as that of the piezoelectric plate 101. As the material of the cover plate 103, a ceramics material such as alumina may also be used. The upper surface of the piezoelectric plate 101 and the lower surface of the cover plate 103 are bonded together with, for example, an epoxy-based adhesive (not shown). The grooves 104 and 105 are sealed with the cover plate 103, and thus, the pressure chambers are formed along the longitudinal direction of the grooves 104 and 105.

Further, the manifold 127 is mounted on the back surface side of the piezoelectric transducer 110 (see FIG. 11). The manifold 127 has the common liquid chamber 125 formed therein for supplying liquid to the pressure chambers 104 in the piezoelectric transducer 110. Liquid stored in a liquid bottle (not shown) is supplied into the manifold 127 through the ink supply port 128 formed on the back surface side of the manifold 127. Further, an ink discharge port (not shown) is also formed on the back surface side of the manifold 127. The ink supply port 128 and the ink discharge port are formed in the manifold 127, and thus, ink can circulate in the manifold 127.

Further, the orifice plate 121 is mounted on the front surface side of the piezoelectric plate 101 (see FIG. 11). The orifice plate 121 can be formed as described below. First, a plate-like substance for forming the orifice plate 121 is prepared. As a material of such a plate-like substance, for example, plastic is used. In this case, as the material of the plate-like substance, for example, a polyimide is used. Then, an ink-repellent film (not shown) is formed on a first principal plane that is one principal plane of the plate-like substance. The first principal plane of the plate-like substance is the principal plane that is opposite to a principal plane (second principal plane) that is opposed to the piezoelectric plate 101 when the orifice plate 121 is mounted to the piezoelectric plate 101. As a material of the ink-repellent film, for example, an amorphous fluorine resin manufactured by ASAHI GLASS CO., LTD. (trade name: CYTOP) is used. Then, a laser beam is radiated to the plate-like substance to form holes in the plate-like substance, to thereby form the nozzles 122. When the holes are formed in the plate-like substance, the laser beam is radiated in a direction from the second principal plane to the first principal plane of the plate-like substance. As the laser beam, for example, an excimer laser is used. The holes formed in the plate-like substance becomes smaller from the second principal plane side toward the first principal plane side of the plate-like substance. A diameter of the nozzles 122 on the first principal plane side of the plate-like substance is, for example, about 20 μm. The nozzles 122 are formed at positions corresponding to those of the pressure chambers (liquid channels) 104, respectively. In this way, the orifice plate 121 having the nozzles 122 formed therein is obtained. The orifice plate 121 is bonded to the end surface (bonded surface) 132 of the piezoelectric plate 101 on the front surface side using, for example, an epoxy-based adhesive (not shown).

Further, the flexible substrate 129 is mounted to the lower surface side of the piezoelectric plate 101 (see FIG. 11). The wiring connected to the terminals 130 and the wiring connected to the terminals 131 are formed on the flexible substrate 129. The terminals 131 are electrically connected to the electrodes 106 formed in the pressure chambers 104, respectively. The terminals 130 are electrically connected to the electrodes 107 formed in the dummy chambers 105 and on the partitions 102, respectively. A signal voltage is individually applied to each of the terminals 130. The terminals 131 are, for example, connected to the ground potential GND. The flexible substrate 129 and the piezoelectric plate 101 are aligned, and the flexible substrate 129 and the piezoelectric plate 101 are bonded together by thermocompression bonding, for example.

In this way, in this embodiment, the electrodes 107 are formed not only on the side walls 114 of the partitions 102 but also on the upper surfaces of the partitions 102, and thus, the electric field applied to the partitions 102 can be increased. Therefore, according to this embodiment, the partitions 102 can be more easily displaced in the shear mode, and the efficiency of displacing the partitions 102 can be improved.

Modified Example (No. 1)

Figure 22:
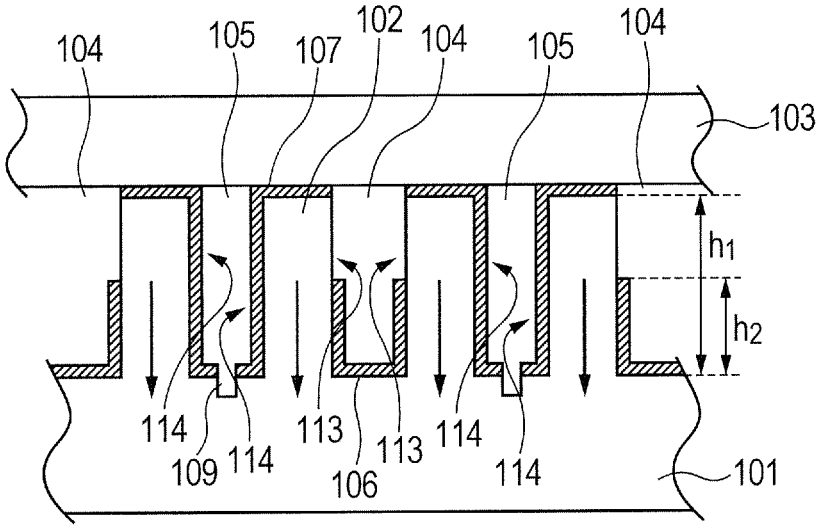
FIG. 22 is a sectional view illustrating a piezoelectric transducer of a liquid ejection device according to a modified example (No. 1) of the third embodiment of the present invention.

Next, a liquid ejection device according to a modified example (No. 1) of this embodiment is described with reference to FIG. 22. FIG. 22 is a sectional view illustrating a piezoelectric transducer of the liquid ejection device according to this modified example.

In the piezoelectric transducer of the liquid ejection device according to this modified example, the electrode 107 is formed on an entire surface of the side wall 114 of the partition 102 facing the dummy chamber 105.

As illustrated in FIG. 22, the electrode 107 is formed on the entire surface of the side wall 114 of the partition 102 facing the dummy chamber 105. A portion of the electrode 107 formed on the upper surface of the partition 102 and a portion of the electrode 107 formed on the side wall 114 of the partition 102 are integral with each other.

The height $h_2$ of the electrode 106 is set so that a sufficient electric field can be applied to the partition 102 to sufficiently displace the partition 102. When the height $h_2$ of the electrode 106 is smaller than 35% of the height $h_1$ of the partition 102, the partition 102 cannot necessarily be displaced by a sufficient amount of displacement. On the other hand, when the height $h_2$ of the electrode 106 is larger than 57% of the height $h_1$ of the partition 102, the partition 102 cannot necessarily be displaced by a sufficient amount of displacement. Therefore, it is preferred that the height $h_2$ of the electrode 106 be in a range of from 35% or more to 57% or less of the height $h_1$ of the partition 102. When the height $h_1$ of the partition 102 is, for example, 230 μm, it is preferred that the height $h_2$ of the electrode 106 be, for example, in a range of from 80 μm to 130 μm.

As described above, the electrode 107 may be formed on the entire surface of the side wall 114 of the partition 102 facing the dummy chambers 105.

Modified Example (No. 2)

Figure 23:
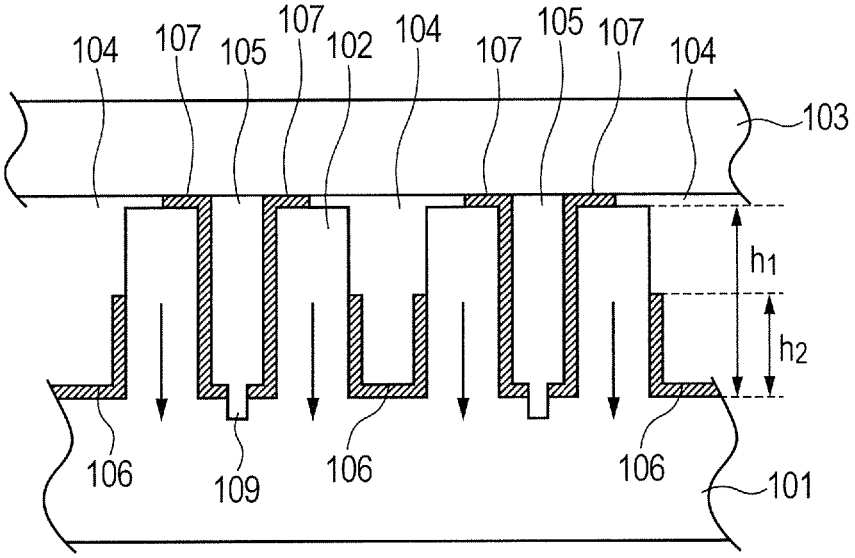
FIG. 23 is a sectional view illustrating a piezoelectric transducer of a liquid ejection device according to another modified example (No. 2) of the third embodiment of the present invention.

Next, a liquid ejection device according to a modified example (No. 2) of this embodiment is described with reference to FIG. 23. FIG. 23 is a sectional view illustrating a piezoelectric transducer of the liquid ejection device according to this modified example.

In the piezoelectric transducer of the liquid ejection device according to this modified example, a portion of the electrode 107 positioned on the upper surface of the partition 102 covers a part of the upper surface of the partition 102.

In this modified example, an area of the portion of the electrode 107 positioned on the upper surface of the partition 102 is smaller than that in the case of the modified example (No. 1) illustrated in FIG. 22.

In this way, the portion of the electrode 107 positioned on the upper surface of the partition 102 may cover only a part of the upper surface of the partition 102.

Modified Example (No. 3)

Figure 24:
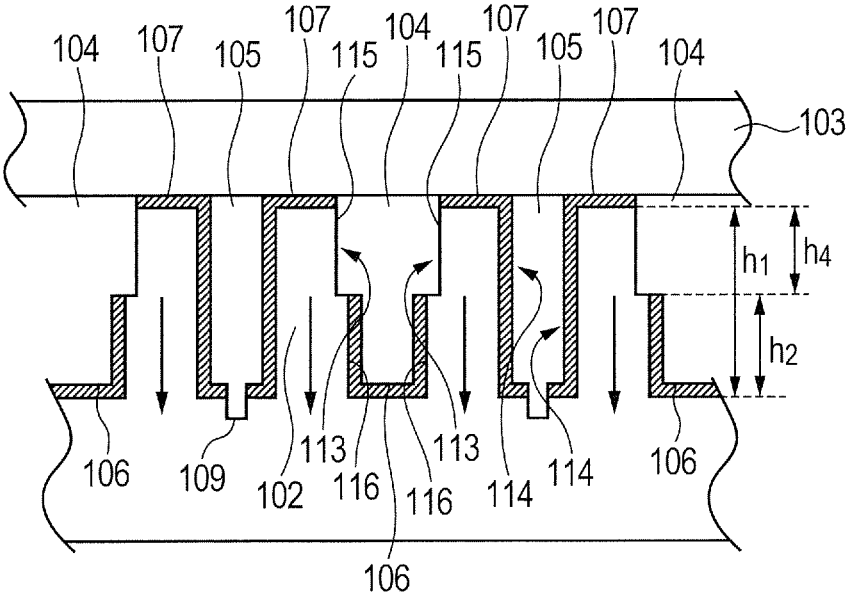
FIG. 24 is a sectional view illustrating a piezoelectric transducer of a liquid ejection device according to another modified example (No. 3) of the third embodiment of the present invention.

Next, a liquid ejection device according to a modified example (No. 3) of this embodiment is described with reference to FIG. 24. FIG. 24 is a sectional view illustrating a piezoelectric transducer of the liquid ejection device according to this modified example.

In the piezoelectric transducer of the liquid ejection device according to this modified example, a wall surface 115 positioned in an upper portion of the side wall 113 facing the pressure chamber 104 is positioned so as to be set back from a wall surface 116 positioned below the wall surface 115 in a direction of a normal to the wall surface 115.

As illustrated in FIG. 24, in this modified example, an upper portion of the side wall 113 facing the pressure chamber 104 is ground and the upper portion of the partition 102 has a smaller thickness. Therefore, the wall surface 115 positioned in the upper portion of the side wall 113 facing the pressure chamber 104 is positioned so as to be set back from the wall surface 116 positioned below the wall surface 115 in the direction of the normal to the wall surface 115. The wall surface 115 and the wall surface 116 may be in parallel with each other, or may be slanted with respect to each other. The electrode 106 formed in the pressure chamber 104 is formed so as to cover the wall surface 116, and is not formed on the wall surface 115 positioned above the wall surface 116. A height of the upper end of the electrode 106 is the same as a height of an upper end of the wall surface 116.

The electrode 107 covers the entire surface of the side wall 114 of the partition 102 facing the dummy chamber 105, and further, covers the entire upper surface of the partition 102.

In this way, the wall surface 115 positioned in the upper portion of the side wall 113 facing the pressure chamber 104 may be positioned so as to be set back from the wall surface 116 positioned below the wall surface 115 in the direction of the normal to the wall surface 115. The wall surface 115 and the wall surface 116 may be in parallel with each other, or may be slanted with respect to each other. According to this modified example, the upper portion of the partition 102 has a smaller thickness, and thus, the partition 102 is more easily displaced. Therefore, according to this modified example, the partitions 102 can be more easily displaced in the shear mode, and the efficiency of displacing the partitions 102 can be more improved.

Modified Example (No. 4)

Figure 25:
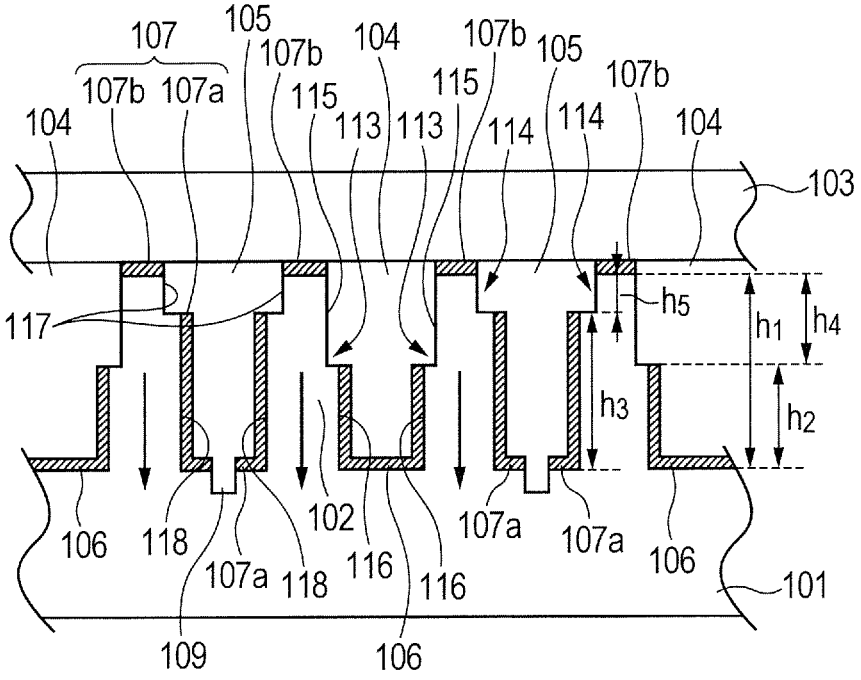
FIG. 25 is a sectional view illustrating a piezoelectric transducer of a liquid ejection device according to another modified example (No. 4) of the third embodiment of the present invention.

Next, a liquid ejection device according to a modified example (No. 4) of this embodiment is described with reference to FIG. 25. FIG. 25 is a sectional view illustrating a piezoelectric transducer of the liquid ejection device according to this modified example.

In the piezoelectric transducer of the liquid ejection device according to this modified example, a wall surface 117 positioned in an upper portion of the side wall 114 facing the dummy chamber 105 is positioned so as to be set back from a wall surface 118 positioned below the wall surface 117 in a direction of a normal to the wall surface 117.

As illustrated in FIG. 25, in this modified example, similarly to the modified example (No. 3), the upper portion of the side wall 113 facing the pressure chamber 104 is ground and the upper portion of the partition 102 has a smaller thickness. Therefore, the wall surface 115 positioned in the upper portion of the side wall 113 facing the pressure chamber 104 is positioned so as to be set back from the wall surface 116 positioned below the wall surface 115 in the direction of the normal to the wall surface 115. The electrode 106 formed in the pressure chamber 104 is formed so as to cover the wall surface 116, and is not formed on the wall surface 115 positioned above the wall surface 116. A height of the upper end of the electrode 106 is the same as a height of an upper end of the wall surface 116.

Further, in this modified example, an upper portion of the side wall 114 facing the dummy chamber 105 is ground, and thus, the upper portion of the partition 102 is further reduced in thickness. Therefore, the wall surface 117 positioned in the upper portion of the side wall 114 facing the dummy chamber 105 is positioned so as to be set back from the wall surface 118 positioned below the wall surface 117 in a direction of a normal to the wall surface 117. The wall surface 117 and the wall surface 118 may be in parallel with each other, or may be slanted with respect to each other. The partial electrode 107*a* in the dummy chamber 105 is formed so as to cover the wall surface 118, and is not formed on the wall surface 117 positioned above the wall surface 118. A height of the upper end of the partial electrode 107*a* is the same as a height of an upper end of the wall surface 118. The upper end of the wall surface 118 is positioned above the upper end of the wall surface 116.

The partial electrode 107*b* is formed so as to cover the entire upper surface of the partition 102. The partial electrode 107*a* formed in the dummy chamber 105 and the partial electrode 107*b* formed on the upper surface of the partition 102 are electrically connected to each other in a region (not shown).

As described above, the wall surface 117 positioned in the upper portion of the side wall 114 facing the dummy chamber 105 may be positioned so as to be set back from the wall surface 118 positioned below the wall surface 117 in the direction of the normal to the wall surface 117. The wall surface 117 and the wall surface 118 may be in parallel with each other, or may be slanted with respect to each other. According to this modified example, the upper portion of the partition 102 is further reduced in thickness, and thus, the partition 102 is more easily displaced. Therefore, according to this modified example, the partitions 102 can be more easily displaced in the shear mode, and the efficiency of displacing the partitions 102 can be more improved.

[Evaluation Results]

Next, results of evaluation of the piezoelectric transducer of the liquid ejection device according to this embodiment are described in the following.

Example 8

A piezoelectric transducer of Example 8 had the structure as illustrated in FIG. 14A. The piezoelectric transducer of Example 8 was manufactured as described below.

First, an un-polarized piezoelectric plate 111 (see FIG. 15A) was prepared. As a material of the piezoelectric plate 111, PZT was used. Then, the piezoelectric plate 111 was sintered. Then, HIP processing of the piezoelectric plate 111 was performed at 1,100° C. under a pressure of 1,000 atmospheres. The HIP processing was performed in a 100% argon atmosphere. The HIP processing reduced voids in the piezoelectric plate 111 from 8% to 3%. Then, the electrode 112 for polarization treatment, which was formed of Ag paste and had a thickness of 3 μm, was formed on the upper surface side and the lower surface side of the piezoelectric plate 111 (see FIG. 15B), respectively. Then, by applying a voltage between the electrodes 112 for polarization treatment, polarization treatment of the piezoelectric plate 111 was performed. Intensity of an electric field applied to the piezoelectric plate 111 was 2 kV/mm. A time period over which the polarization treatment was performed was 2 minutes. After the polarization treatment was performed, the electrodes 112 for polarization treatment were removed by grinding. In this way, the polarized piezoelectric plate 101 was obtained.

Then, processing for forming the pressure chambers 104 and the dummy chambers 105 was performed. The dicing blade had a thickness of 80 μm. The dicing blade had a diameter of 64 mm. The diamond grains contained in the dicing blade had a grain size of #1600. As the dicing apparatus, the dicing saw manufactured by DISCO Corporation (trade name: Fully Automatic Dicing Saw, model No: DAD6240, spindle type: 1.2 kW) was used. The dicing blade had a rotation speed of 20,000 rpm. The feeding speed of the stage was 0.2 mm/s. The height $h_1$ of the partition 102 was 230 μm, and the partition 102 had a width (thickness) of 70 μm.

Then, the entire piezoelectric plate 101 was covered with the electroless plating film (not shown). The electroless plating film was formed by applying nickel (Ni) plating to the piezoelectric plate 101. The electroless plating film was formed as described below. Specifically, first, by etching the surface of the piezoelectric plate 101 with a dilute solution of hydrofluoric acid, minute depressions were formed in the surface of the piezoelectric plate 101. Then, by immersing the piezoelectric plate 101 into an aqueous solution of nitric acid with a concentration of 50% for 5 minutes at room temperature, the deleading treatment for removing lead from the surface of the piezoelectric plate 101 was applied. Then, a catalyst was given to the surface of the piezoelectric plate 101 as described below. First, the piezoelectric plate 101 was immersed into an aqueous solution of stannous chloride with a concentration of 0.1% for 2 minutes at room temperature, to thereby adsorb stannous chloride onto the surface of the piezoelectric plate 101. Then, the piezoelectric plate 101 was immersed into an aqueous solution of palladium chloride with a concentration of 0.1% for 2 minutes at room temperature. This causes an oxidation-reduction reaction between tin chloride adsorbed in advance onto the piezoelectric plate 101 and palladium chloride to generate metallic palladium on the surface of the piezoelectric plate 101. After this, an electroless nickel plating film was formed on the surface of the piezoelectric plate 101 as described below. A basic bath of the nickel plating was as described below. As a metal salt contained in the plating bath, nickel sulfate was used. As a reducing agent contained in the plating bath, borane dimethylamine complex (DMAB)($(CH_3)_2NH.BH_3$) was used. A temperature of the plating bath was 60° C. NaOH and $H_2SO_4$ were used to adjust a pH of the plating bath to be 6.0. In this way, a Ni—B electroless plating film having a thickness of about 0.8 μm was formed on the entire surface of the piezoelectric plate 101. Further, through replacement plating, a gold plating film was formed on the entire surface of the piezoelectric plate 101 having the electroless plating film formed thereon. As a gold source contained in the plating bath, gold sodium sulfite was used. The plating bath was a non-cyan-type plating bath. The temperature of the plating bath was 68° C. The pH of the plating bath was 7.3. The thickness of the plating film was 0.05 μm. In this way, the conductive film including the plating films was formed on the entire surface of the piezoelectric plate 101.

Then, the unnecessary portions of the conductive film were removed. Specifically, the portions of the conductive film on the front surface side and on the back surface side of the piezoelectric plate 101 were removed. The amount of polishing when the conductive film on the front surface side and on the back surface side of the piezoelectric plate 101 was removed was 5 μm. Further, the conductive film on the upper portions of the side walls 113 and 114 of the partition 102 was removed. When the unnecessary portions of the conductive film were removed, a dicing blade was used, and the region in the range from the upper surface of the partitions 102 to 115 μm was removed by grinding. The dicing blade had a thickness of 60 μm, the dicing blade had a diameter of 64 mm, and the diamond grains contained in the dicing blade had a grain size of #1600. As the dicing apparatus, the dicing saw manufactured by DISCO Corporation (trade name: Fully Automatic Dicing Saw, model No: DAD6240, spindle type: 1.2 kW) was used. The dicing blade had a rotation speed of 20,000 rpm. The feeding speed of the stage was 0.1 mm/s. The dicing blade that had a sufficiently small thickness with respect to the dicing blade used in forming the grooves 104 and 105 was used, and thus, the dicing blade was able to be introduced into the grooves 104 and 105 without contact with the partition 102. After the height of the dicing blade was adjusted to be a desired height, the stage was moved under a state in which the dicing blade was in contact with the side walls 113 and 114 of the partition 102. The amount of the grinding of the partition 102 by the dicing blade was 2 μm. In this way, the unnecessary portions of the conductive film were removed to form the electrode 106 and the partial electrodes 107*a* and 107*b* in a desired pattern. Examination of machining marks by the dicing blade with use of a microscope revealed that there were steps in the partitions 102 of about 2 μm at the maximum and about 1 μm or less on average.

Then, the cover plate 103 formed of PZT was aligned with the piezoelectric plate 101, and the cover plate 103 was bonded onto the piezoelectric plate 101 with an epoxy adhesive.

In this way, the basic structure of the piezoelectric transducer as illustrated in FIG. 14A was manufactured.

Examples 9 to 11

Piezoelectric transducers of Examples 9 to 11 had the structure as illustrated in FIG. 22.

In each of Examples 9 to 11, the electrode 107 was formed so as to cover the entire side wall 114 of the partition 102 facing the dummy chamber 105 and the entire upper surface of the partition 102.

In Examples 9 to 11, the height $h_2$ of the electrode 106 formed on the side wall 113 facing the pressure chamber 104 of the partition 102 had different values. In Example 9, the height $h_2$ of the upper end of the electrode 106 was 35% of the height of the upper surface of the partition 102. Specifically, in Example 9, the height $h_2$ of the electrode 106 was 80 μm. In Example 10, the height $h_2$ of the upper end of the electrode 106 was 50% of the height of the upper surface of the partition 102. Specifically, in Example 10, the height $h_2$ of the electrode 106 was 115 μm. In Example 11, the height $h_2$ of the upper end of the electrode 106 was 57% of the height of the upper surface of the partition 102. Specifically, in Example 11, the height $h_2$ of the electrode 106 was 130 μm.

Methods of manufacturing the piezoelectric transducers of Examples 9 to 11 were similar to the method of manufacturing the piezoelectric transducer of Example 8. However, in a step of removing unnecessary portions of the conductive film, the height of the dicing blade was appropriately set so that the desired portions of the conductive film were able to be removed as desired.

In this way, the basic structure of the piezoelectric transducer as illustrated in FIG. 22 was manufactured.

Example 12

A piezoelectric transducer of Example 12 had the structure as illustrated in FIG. 23.

In Example 12, the electrode 107 was formed so as to cover the entire side wall 114 of the partition 102 facing the dummy chamber 105 and a part of the upper surface of the partition 102. Specifically, in Example 12, the area of the portion of the electrode 107 positioned on the upper surface of the partition 102 was smaller than that in the case of Example 11.

A method of manufacturing the piezoelectric transducer of Example 12 was similar to the method of manufacturing the piezoelectric transducer of Example 11. However, the unnecessary portion of the conductive film on the upper surface of the partition 102 was removed through scanning with a laser beam. As the laser beam, an excimer laser was used. The laser beam had an energy density of 6 J/cm$^2$. A width of the removed unnecessary portion of the conductive film on the upper surface of the partition 102 was 30 μm.

In this way, the basic structure of the piezoelectric transducer as illustrated in FIG. 23 was manufactured.

Example 13

A piezoelectric transducer of Example 13 had the structure as illustrated in FIG. 24.

In Example 13, by grinding the upper portion of the side wall 113 facing the pressure chamber 104, the upper portion of the partition 102 was reduced in thickness. Further, in Example 13, the electrode 107 was formed so as to cover the entire side wall 114 of the partition 102 facing the dummy chamber 105 and the entire upper surface of the partition 102.

A method of manufacturing the piezoelectric transducer of Example 13 was similar to the methods of manufacturing the piezoelectric transducers of Examples 9 to 11. However, when the unnecessary portion of the conductive film on the side wall 113 facing the pressure chamber 104 was removed, a dicing blade having a thickness of 100 μm was used. A center line of dicing of the dicing blade was aligned with a center line of the pressure chamber 104 in the longitudinal direction thereof. The dicing blade used to remove the unnecessary portion of the conductive film on the side wall 113 had a thickness larger than the thickness of the dicing blade used to form the pressure chamber 104. Thus, the upper portion of the side wall 113 of the partition 102 facing the pressure chamber 104 was ground. With this, the wall surface 115 positioned in the upper portion of the side wall 113 was positioned so as to be set back from the wall surface 116 positioned below the wall surface 115 in the direction of the normal to the wall surface 115. The wall surface 115 had a height $h_4$ of 115 μm. The upper portion of the partition 102 had a thickness of 60 μm.

In this way, the basic structure of the piezoelectric transducer as illustrated in FIG. 24 was manufactured.

Example 14

A piezoelectric transducer of Example 14 had the structure as illustrated in FIG. 25.

In Example 14, by grinding the upper portion of the side wall 113 facing the pressure chamber 104, the upper portion of the partition 102 was reduced in thickness, and further, by grinding the upper portion of the side wall 114 facing the dummy chamber 105, the upper portion of the partition 102 was further reduced in thickness.

A method of manufacturing the piezoelectric transducer of Example 14 was similar to the method of manufacturing the piezoelectric transducer of Example 13. However, when the unnecessary portion of the conductive film on the side wall 114 facing the dummy chamber 105 was removed, a dicing blade having a thickness of 100 μm was used. A center line of dicing of the dicing blade was aligned with a center line of the dummy chamber 105 in the longitudinal direction thereof. The dicing blade used to remove the unnecessary portion of the conductive film on the side wall 114 had a thickness larger than the thickness of the dicing blade used to form the dummy chamber 105. Thus, the upper portion of the side wall 114 of the partition 102 facing the dummy chamber 105 was ground. With this, the wall surface 117 positioned in the upper portion of the side wall 114 was positioned so as to be set back from the wall surface 118 positioned below the wall surface 117 in the direction of the normal to the wall surface 117. The wall surface 117 had a height $h_5$ of 34 μm. The wall surface 118 had a height of 196 μm. The upper portion of the partition 102 had a thickness of 50 μm.

In this way, the basic structure of the piezoelectric transducer as illustrated in FIG. 25 was manufactured.

Comparative Example 6

Figure 26:
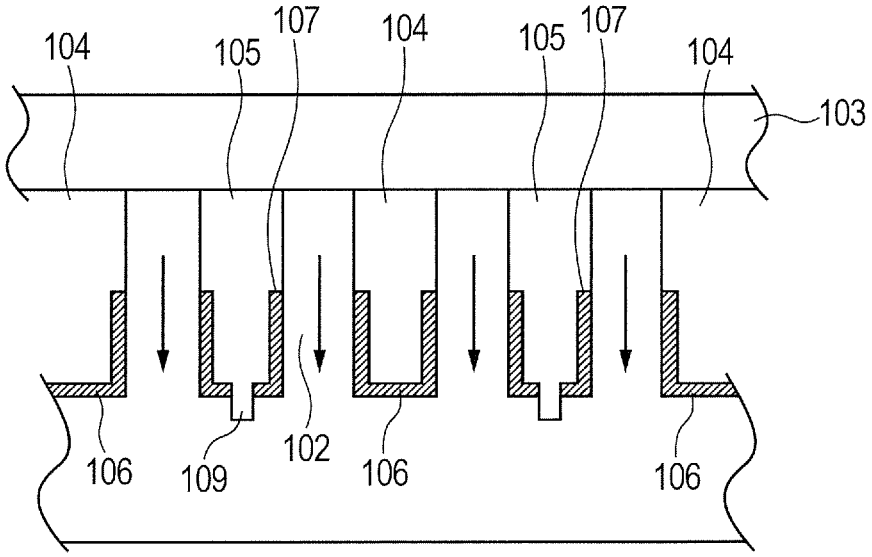
FIG. 26 is a sectional view illustrating a piezoelectric transducer of a liquid ejection device according to Comparative Example 6.

A piezoelectric transducer of Comparative Example 6 had the structure as illustrated in FIG. 26. FIG. 26 is a sectional view illustrating the piezoelectric transducer of a liquid ejection device according to Comparative Example 6.

In Comparative Example 6, the electrode 107 was not formed on the upper surface of the partition 102.

A method of manufacturing the piezoelectric transducer of Comparative Example 6 was similar to the method of manufacturing the piezoelectric transducer of Example 8. However, the unnecessary portion of the conductive film on the upper surface of the partition 102 was removed by polishing. An amount of polishing at the time when the unnecessary portion of the conductive film existing on the upper surface of the partition 102 was removed was 5 μm.

In this way, the basic structure of the piezoelectric transducer as illustrated in FIG. 26 was manufactured.

Comparative Examples 7 and 8

Piezoelectric transducers of Comparative Examples 7 and 8 had the structure as illustrated in FIG. 22.

In each of Comparative Examples 7 and 8, the electrode 107 was formed so as to cover the entire side wall 114 of the partition 102 facing the dummy chamber 105 and the entire upper surface of the partition 102.

In Comparative Example 7, the height $h_2$ of the upper end of the electrode 106 was 28% of the height $h_1$ of the upper surface of the partition 102. Specifically, in Comparative Example 7, the height $h_2$ of the electrode 106 was 65 μm.

In Comparative Example 8, the height $h_2$ of the upper end of the electrode 106 was 63% of the height $h_1$ of the upper surface of the partition 102. Specifically, in Comparative Example 8, the height $h_2$ of the electrode 106 was 145 μm.

In this way, the basic structure of the piezoelectric transducer as illustrated in FIG. 22 was manufactured.

Table 2 shows results of evaluation of the amounts of displacement of the piezoelectric transducers formed as described above. With reference to the amount of displacement in the case of Comparative Example 6, the ratios of the amount of displacement to the amount of displacement in the case of Comparative Example 6 are shown. The amount of displacement was a difference between the position of the partition 102 in an initial state (see FIG. 14A) and the position of the partition 102 at the time when the partition 102 was displaced so that the capacity of the pressure chambers 104 was at the minimum (see FIG. 14B). When the amount of displacement was measured, a sinusoidal wave of 1 kHz and ±5 V was applied between the electrodes 106 and 107 of the piezoelectric transducer. A maximum displacement of the partition 102 was measured using a laser displacement gauge.

TABLE 2

| | Amount of displacement (nm/10 V) | Ratio to amount of displacement in Comparative Example 6 |
|---|---|---|
| Example 8 | 4.6 | 1.07 |
| Example 9 | 4.4 | 1.02 |
| Example 10 | 4.6 | 1.07 |
| Example 11 | 4.4 | 1.02 |
| Example 12 | 4.4 | 1.02 |

TABLE 2-continued

| | Amount of displacement (nm/10 V) | Ratio to amount of displacement in Comparative Example 6 |
|---|---|---|
| Example 13 | 5.1 | 1.19 |
| Example 14 | 4.9 | 1.14 |
| Comparative Example 6 | 4.3 | 1.00 |
| Comparative Example 7 | 4.1 | 0.95 |
| Comparative Example 8 | 4.2 | 0.98 |

As can be seen from Table 2, in each of the cases of Examples 8 to 14, the amount of displacement is larger than that in the case of Comparative Example 6. When the same voltage is applied, a piezoelectric transducer having a larger amount of displacement is more excellent in performance.

As can be seen from Table 2, according to the liquid ejection device according to this embodiment described above, the efficiency of displacing the partition 102 may be improved with reliability. Therefore, according to this embodiment, dielectric loss, an amount of produced heat, damage to the partition 102, a load on a driver element, and the like are inhibited, and still a desired amount of displacement can be obtained. Therefore, according to this embodiment, a satisfactory liquid ejection device with high reliability can be obtained.

Table 3 shows results of evaluation of ejection performance of the liquid ejection devices formed as described above. With reference to a voltage necessary for attaining an ejection speed of 5 m/s in the case of Comparative Example 6, the ratios of the voltage to the voltage necessary in the case of Comparative Example 6 are shown. The ejection speed of 5 m/s is an ejection speed necessary for rendering an image with a relatively high resolution.

As liquid (ink) to be ejected, a liquid mixture of 85% ethylene glycol and 15% water was used. The ink was introduced from the ink supply port 128 of the manifold 127 into the piezoelectric transducer 110 through a Tygon tube (not shown).

When the evaluation was made, a voltage of a rectangular wave having a pulse width of 8 ρsec was applied between the electrodes 106 and 107 of the piezoelectric transducer 110. The voltage applied between the electrodes 106 and 107 of the piezoelectric transducer 110 was changed, and a voltage at the time when the ejection speed of 5 m/s was obtained was determined.

TABLE 3

| | Voltage (V) necessary for ejection speed of 5 m/s | Ratio to voltage necessary in Comparative Example 6 |
|---|---|---|
| Example 8 | 23.8 | 0.95 |
| Example 9 | 24.6 | 0.98 |
| Example 10 | 23.7 | 0.94 |
| Example 11 | 24.5 | 0.98 |
| Example 12 | 24.2 | 0.96 |
| Example 13 | 21.5 | 0.86 |
| Example 14 | 22.2 | 0.88 |
| Comparative Example 6 | 25.1 | 1.00 |
| Comparative Example 7 | 26.3 | 1.05 |
| Comparative Example 8 | 26.2 | 1.04 |

As can be seen from Table 3, in each of the cases of Examples 8 to 14, the voltage necessary for obtaining the ejection speed of 5 m/s is lower than that in the case of Comparative Example 6. Therefore, according to this embodiment, dielectric loss, an amount of produced heat, damage to the partition 102, a load on a driver element, and the like are inhibited, and still a desired ejection speed can be obtained. Because the amount of produced heat can be inhibited, a viscosity of the ink can be prevented from being reduced due to a temperature rise to prevent the ejection speed from being reduced, and, by extension, a liquid ejection device having a sufficient image rendering resolution can be provided.

Modified Embodiments

The present invention is not limited to the embodiments described above, and various modifications can be made.

For example, in the third embodiment, a case is described by way of example in which the partial electrode 107*b* positioned on the upper surface of the partition 102 is electrically connected to the partial electrode 107*a* formed in the dummy chamber 105, but the present invention is not limited thereto. For example, the partial electrode 107*b* positioned on the upper surface of the partition 102 may be electrically connected to the electrode 106 formed in the pressure chamber 104.

Further, the pressure chamber 105 may be used as a liquid channel, not as a dummy chamber. In this case, liquid is supplied also to the pressure chamber 105 from the manifold 127. Further, in this case, the nozzles 122 are formed not only in regions corresponding to the pressure chambers 104 but also in regions corresponding to the pressure chambers 105.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-096529, filed May 8, 2014, and No. 2014-096777, filed May 8, 2014 which are hereby incorporated by reference herein in their entirety.

REFERENCE SIGNS LIST

1 . . . piezoelectric plate
2*a* . . . liquid channel
3*a*, 3*b* . . . electrode
4 . . . partition
41 . . . wall surface
42 . . . wall surface
43 . . . wall surface
44 . . . wall surface
5 . . . cover plate
101 . . . piezoelectric plate
102 . . . partition
103 . . . cover plate
104 . . . pressure chamber
105 . . . dummy chamber
106, 107 . . . electrode
107*a*, 107*b* . . . partial electrode
109 . . . separating groove

The invention claimed is:

1. A liquid ejection device, comprising:
a piezoelectric transducer including:
a plurality of pressure chambers;
a plurality of partitions each including a piezoelectric material and dividing the plurality of pressure chambers; and
a plurality of electrodes formed in the plurality of pressure chambers, respectively,
wherein the plurality of partitions each include a first side wall and a second side wall that is positioned on a back surface side of the first side wall,
wherein the first side wall includes a first wall surface positioned at an upper portion thereof, the first wall surface being positioned so as to be set back from a second wall surface positioned below the first wall surface in a direction normal to the first wall surface,
wherein a first electrode of the plurality of electrodes is formed on the second wall surface,
wherein a second electrode of the plurality of electrodes is formed on the second side wall,
wherein an upper end of the second electrode is disposed higher than an upper end of the first electrode, and
wherein no electrode is formed on the first wall surface.

2. The liquid ejection device according to claim 1,
wherein the second side wall includes a third wall surface positioned at an upper portion thereof, the third wall surface being positioned so as to be set back from a fourth wall surface positioned below the third wall surface in a direction normal to the third wall surface,
wherein an upper end of the fourth wall surface is positioned above an upper end of the second wall surface,
wherein the second electrode is formed on the fourth wall surface, and
wherein the height of the upper end of the second electrode is the same as a height of the upper end of the fourth wall surface.

3. The liquid ejection device according to claim 2,
wherein a height of the fourth wall surface is 1.4 times or more as much as a height of the second wall surface, and
wherein the height of the fourth wall surface is more than 50% of a height of the second side wall.

4. The liquid ejection device according to claim 1, wherein a height of the second wall surface is 25% or more and 65% or less of a height of the first side wall.

5. The liquid ejection device according to claim 1, wherein the first wall surface is set back by 10 μm or more from the second wall surface in the direction normal to the first wall surface.

6. The liquid ejection device according to claim 1, wherein an upper portion of each of the plurality of partitions has a thickness of 30 μm or more.

7. The liquid ejection device according to claim 1, wherein a pressure chamber facing the first side wall among the plurality of pressure chambers is used as a liquid channel.

8. A liquid ejection device, comprising:
a piezoelectric transducer including:
a plurality of pressure chambers;
a plurality of partitions each including a piezoelectric material and dividing the plurality of pressure chambers; and
a plurality of electrodes formed in the plurality of pressure chambers, respectively,
wherein the plurality of partitions each include a first side wall and a second side wall that is positioned on a back surface side of the first side wall,
wherein the first side wall includes a first wall surface positioned at an upper portion thereof, the first wall surface being positioned so as to be set back from a second wall surface positioned below the first wall surface in a direction normal to the first wall surface, wherein a first electrode of the plurality of electrodes is formed on the second wall surface, wherein a second electrode of the plurality of electrodes is formed on the second side wall and an upper surface of each of the plurality of partitions, and wherein a height of an upper end of the first electrode is the same as a height of an upper end of the second wall surface.

9. The liquid ejection device according to claim 8, wherein the second side wall includes a third wall surface positioned at an upper portion thereof, the third wall surface being positioned so as to be set back from a fourth wall surface positioned below the third wall surface in a direction normal to the third wall surface, wherein an upper end of the fourth wall surface is positioned above the upper end of the second wall surface, wherein the second electrode is formed on the fourth wall surface, and wherein a height of an upper end of the second electrode is the same as a height of an upper end of the fourth wall surface.

10. The liquid ejection device according to claim 8, wherein a height of the first electrode is 35% or more and 57% or less of a height of the first side wall, and wherein the second electrode is formed on an entire surface of the second side wall.

* * * * *